US007412067B2

(12) United States Patent
Koyama

(10) Patent No.: US 7,412,067 B2
(45) Date of Patent: Aug. 12, 2008

(54) ACOUSTIC APPARATUS AND ACOUSTIC SETTING METHOD

(75) Inventor: Hiroshi Koyama, Kanagawa (JP)

(73) Assignee: Sony Corporation (JP)

( * ) Notice: Subject to any disclaimer, the term of this patent is extended or adjusted under 35 U.S.C. 154(b) by 810 days.

(21) Appl. No.: 10/863,462

(22) Filed: Jun. 8, 2004

(65) Prior Publication Data

US 2004/0258259 A1 Dec. 23, 2004

(30) Foreign Application Priority Data

Jun. 19, 2003 (JP) ..... P2003-174881

(51) Int. Cl.
*H04R 5/02* (2006.01)

(52) U.S. Cl. ..... 381/307; 381/300

(58) Field of Classification Search ..... 381/300, 381/303–307, 61, 80–82, 85
See application file for complete search history.

(56) References Cited

U.S. PATENT DOCUMENTS

| | | | | |
|---|---|---|---|---|
| 6,125,115 | A * | 9/2000 | Smits | 370/389 |
| 6,504,936 | B1 * | 1/2003 | Gutierrez | 381/77 |
| 6,704,421 | B1 * | 3/2004 | Kitamura | 381/103 |
| 6,977,653 | B1 * | 12/2005 | Cleary et al. | 345/440 |
| 7,085,387 | B1 * | 8/2006 | Metcalf | 381/26 |
| 7,305,097 | B2 * | 12/2007 | Rosen et al. | 381/307 |
| 2004/0161126 | A1 * | 8/2004 | Rosen et al. | 381/307 |

FOREIGN PATENT DOCUMENTS

| | | |
|---|---|---|
| JP | 06-311580 | 11/1994 |
| JP | 07-056563 | 3/1995 |
| JP | 09-259539 | 10/1997 |
| JP | 3094994 | 10/2000 |
| JP | 2001-218300 | 8/2001 |
| JP | 2001-352600 | 12/2001 |
| JP | 2002-369299 | 12/2002 |
| JP | 2003-032799 | 1/2003 |

* cited by examiner

*Primary Examiner*—Vivian Chin
*Assistant Examiner*—Disler Paul
(74) *Attorney, Agent, or Firm*—Lerner, David, Littenberg, Krumholz & Mentlik, LLP

(57) ABSTRACT

A setting up operation for connecting a number of speakers can be easily executed by a system in which setups and pattern numbers are stored in a memory. When the user operates an operation input unit and selects an easy setup, a default setting pattern number is read out from the memory and displayed on the display. The user operates encoders by watching display contents on a display. When the pattern number corresponding to his own speaker construction obtained by a chart or the like is displayed, he determines it by a key operation. A microcomputer stores the determined pattern number in a memory and the speaker setup corresponding to the pattern number is read out from a ROM in the microcomputer. Each unit of an acoustic apparatus is controlled on the basis of the read-out speaker setup, thereby performing the speaker setup. The user can perform the speaker setup merely by inputting the pattern number using the encoders.

7 Claims, 39 Drawing Sheets

Fig. 2

| SPEAKER SETUP | | 1 | 2 | 3 | 4 | 5 | 6 | 7 | 8 |
|---|---|---|---|---|---|---|---|---|---|
| FRONT SPEAKERS | PRESENT | ○ | ○ | ○ | ○ | ○ | ○ | ○ | ○ |
| | ABSENT | | | | | | | | |
| CENTER SPEAKERS | PRESENT | | | ○ | ○ | | | ○ | ○ |
| | ABSENT | ○ | ○ | | | ○ | ○ | | |
| SURROUND SPEAKERS | PRESENT | | | | | ○ | ○ | ○ | ○ |
| | ABSENT | ○ | ○ | ○ | ○ | | | | |
| SUB WOOFER | PRESENT | | ○ | | ○ | | ○ | | ○ |
| | ABSENT | ○ | | ○ | | ○ | | ○ | |

| SPEAKER SETTING PATTERN NUMBER (SYMBOL) | 2-0 | 2-1 | 3-0 | 3-1 | 4-0 | 4-1 | 5-0 | 5-1 |
|---|---|---|---|---|---|---|---|---|

Fig. 3

| | | | 1 | 2 | 3 | 4 | 5 | 6 | 7 | | 8 | 9 | 10 | | 11 | 12 | 13 | | 14 | 15 | 16 | | 17 | 18 | 19 | 20 | | | | 21 | 22 | 23 |
|---|---|---|---|---|---|---|---|---|---|---|---|---|---|---|---|---|---|---|---|---|---|---|---|---|---|---|---|---|---|---|---|---|
| FL,FR | PRESENT | LARGE | ○ | | ○ | | ○ | ○ | | | ○ | ○ | | | ○ | ○ | | | ○ | ○ | | | ○ | ○ | ○ | ○ | | | | | ○ | ○ |
| | | SMALL | | ○ | | ○ | | | ○ | ○ | | | ○ | ○ | | | ○ | ○ | | | ○ | ○ | | | | | ○ | ○ | ○ | ○ | | |
| | ABSENT | | | | | | | | | | | | | | | | | | | | | | | | | | | | | | | |
| C | PRESENT | LARGE | | | | | ○ | | | ○ | ○ | | | ○ | | | | | | | | | ○ | | ○ | | ○ | | ○ | | ○ | |
| | | SMALL | | | | | | ○ | ○ | | | ○ | ○ | | | | | | | | | | | ○ | | ○ | | ○ | | ○ | | ○ |
| | ABSENT | | ○ | ○ | ○ | ○ | | | | | | | | | ○ | ○ | ○ | ○ | ○ | ○ | ○ | ○ | | | | | | | | | | |
| SL,SR | PRESENT | LARGE | | | | | | | | | | | | | ○ | | | ○ | ○ | | | ○ | ○ | ○ | | | ○ | ○ | | | ○ | ○ |
| | | SMALL | | | | | | | | | | | | | | ○ | ○ | | | ○ | ○ | | | | ○ | ○ | | | ○ | ○ | | |
| | ABSENT | | ○ | ○ | ○ | ○ | ○ | ○ | ○ | ○ | ○ | ○ | ○ | ○ | | | | | | | | | | | | | | | | | | |
| SW | PRESENT | | | | ○ | ○ | | | | | ○ | ○ | ○ | ○ | | | | | ○ | ○ | ○ | ○ | | | | | | | | | ○ | ○ |
| | ABSENT | | ○ | ○ | | | ○ | ○ | ○ | ○ | | | | | ○ | ○ | ○ | ○ | | | | | ○ | ○ | ○ | ○ | ○ | ○ | ○ | ○ | | |
| SP SETTING PATTERN NUMBER | | | 2-0 | 2-0 | 2-1 | 2-1 | 3-0 | 3-0 | 3-0 | 3-0 | 3-1 | 3-1 | 3-1 | 3-1 | 4-0 | 4-0 | 4-0 | 4-0 | 4-1 | 4-1 | 4-1 | 4-1 | 5-0 | 5-0 | 5-0 | 5-0 | 5-0 | 5-0 | 5-0 | 5-0 | 5-1 | 5-1 |

| | | | 24 | 25 | | | | 26 |
|---|---|---|---|---|---|---|---|---|
| FL,FR | PRESENT | LARGE | ○ | ○ | | | | |
| | | SMALL | | | ○ | ○ | ○ | ○ |
| | ABSENT | | | | | | | |
| C | PRESENT | LARGE | ○ | | ○ | | ○ | |
| | | SMALL | | ○ | | ○ | | ○ |
| | ABSENT | | | | | | | |
| SL,SR | PRESENT | LARGE | | | ○ | ○ | | |
| | | SMALL | ○ | ○ | | | ○ | ○ |
| | ABSENT | | | | | | | |
| SW | PRESENT | | ○ | ○ | ○ | ○ | ○ | ○ |
| | ABSENT | | | | | | | |
| SP SETTING PATTERN NUMBER | | | 5-1 | 5-1 | 5-1 | 5-1 | 5-1 | 5-1 |

Fig. 4

| | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|---|---|
| FRONT | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| CENTER | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| | | NO | | | | | | | | | | | | | | | | | | | | | | | | | |
| SURR. | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| | | NO | | | | | | | | | | | | | | | | | | | | | | | | | |
| | HEIGHT | LOW | ○ | ○ | ○ | ○ | ○ | ○ | ○ | ○ | ○ | ○ | ○ | ○ | ○ | ○ | ○ | | | | | | | | | | |
| | | HIGH | | | | | | | | | | | | | | | | ○ | ○ | ○ | ○ | ○ | ○ | ○ | ○ | ○ | ○ |
| | POSI | SIDE | ○ | ○ | ○ | ○ | ○ | | | | | | | | | | | ○ | ○ | ○ | ○ | ○ | | | | | |
| | | MIDDLE | | | | | | ○ | ○ | ○ | ○ | ○ | | | | | | | | | | | ○ | ○ | ○ | ○ | ○ |
| | | BEHIND | | | | | | | | | | | ○ | ○ | ○ | ○ | ○ | | | | | | | | | | |
| SURR. BACK | SIZE | LARGE | ○ | ○ | | | | ○ | ○ | | | | ○ | ○ | | | | ○ | ○ | | | | ○ | ○ | | | |
| | | SMALL | | | ○ | ○ | | | | ○ | ○ | | | | ○ | ○ | | | | ○ | ○ | | | | ○ | ○ | |
| | | NO | | | | | ○ | | | | | ○ | | | | | ○ | | | | | ○ | | | | | ○ |
| | HEIGHT | LOW | ○ | | ○ | | / | ○ | | ○ | | / | ○ | | ○ | | / | ○ | | ○ | | / | ○ | | ○ | | / |
| | | HIGH | | ○ | | ○ | / | | ○ | | ○ | / | | ○ | | ○ | / | | ○ | | ○ | / | | ○ | | ○ | / |
| | POSI | SIDE | | | | | / | | | | | / | | | | | / | | | | | / | | | | | / |
| | | MIDDLE | | | | | / | | | | | / | | | | | / | | | | | / | | | | | / |
| | | BEHIND | ○ | ○ | ○ | ○ | / | ○ | ○ | ○ | ○ | / | ○ | ○ | ○ | ○ | / | ○ | ○ | ○ | ○ | / | ○ | ○ | ○ | ○ | / |

| | | | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 |
|---|---|---|---|---|---|---|---|---|---|---|---|---|---|---|---|---|---|---|---|---|---|---|---|---|---|---|
| FRONT | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | |
| CENTER | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | |
| | | NO | | | | | | | | | | | | | | | | | | | | | | | | |
| SURR. | SIZE | LARGE | ○ | ○ | ○ | ○ | ○ | | | | | | | | | | | | | | | | | | | |
| | | SMALL | | | | | | ○ | ○ | ○ | ○ | ○ | ○ | ○ | ○ | ○ | ○ | ○ | ○ | ○ | ○ | ○ | ○ | ○ | ○ | |
| | | NO | | | | | | | | | | | | | | | | | | | | | | | | ○ |
| | HEIGHT | LOW | | | | | | ○ | ○ | ○ | ○ | ○ | ○ | ○ | ○ | ○ | | | | | | | | | | / |
| | | HIGH | ○ | ○ | ○ | ○ | ○ | | | | | | | | | | ○ | ○ | ○ | ○ | ○ | ○ | ○ | ○ | ○ | / |
| | POSI | SIDE | | | | | | ○ | ○ | ○ | | | | | | | ○ | ○ | ○ | | | | | | | / |
| | | MIDDLE | | | | | | | | | ○ | ○ | ○ | | | | | | | ○ | ○ | ○ | | | | / |
| | | BEHIND | ○ | ○ | ○ | ○ | ○ | | | | | | | ○ | ○ | ○ | | | | | | | ○ | ○ | ○ | / |
| SURR. BACK | SIZE | LARGE | ○ | ○ | | | | | | | | | | | | | | | | | | | | | | / |
| | | SMALL | | | ○ | ○ | | ○ | ○ | | ○ | ○ | | ○ | ○ | | ○ | ○ | | ○ | ○ | | ○ | ○ | | / |
| | | NO | | | | | ○ | | | ○ | | | ○ | | | ○ | | | ○ | | | ○ | | | ○ | / |
| | HEIGHT | LOW | ○ | | ○ | | / | ○ | | / | ○ | | / | ○ | | / | ○ | | / | ○ | | / | ○ | | / | / |
| | | HIGH | | ○ | | ○ | / | | ○ | / | | ○ | / | | ○ | / | | ○ | / | | ○ | / | | ○ | / | / |
| | POSI | SIDE | | | | | / | | | / | | | / | | | / | | | / | | | / | | | / | / |
| | | MIDDLE | | | | | / | | | / | | | / | | | / | | | / | | | / | | | / | / |
| | | BEHIND | ○ | ○ | ○ | ○ | / | ○ | ○ | / | ○ | ○ | / | ○ | ○ | / | | ○ | / | ○ | ○ | / | ○ | ○ | / | / |

Fig. 5

| | | | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 |
|---|---|---|---|---|---|---|---|---|---|---|---|---|---|---|---|---|---|---|---|---|---|---|---|---|---|---|---|
| FRONT | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| CENTER | SIZE | LARGE | | | | | | | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | NO | | | | | | | | | | | | | | | | | | | | | | | | | |
| SURR. | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| | | NO | | | | | | | | | | | | | | | | | | | | | | | | | |
| | HEIGHT | LOW | ○ | ○ | ○ | ○ | ○ | ○ | ○ | ○ | ○ | ○ | ○ | ○ | ○ | ○ | ○ | | | | | | | | | | |
| | | HIGH | | | | | | | | | | | | | | | | ○ | ○ | ○ | ○ | ○ | ○ | ○ | ○ | ○ | ○ |
| | POSI | SIDE | ○ | ○ | ○ | ○ | ○ | | | | | | | | | | | ○ | ○ | ○ | ○ | ○ | | | | | |
| | | MIDDLE | | | | | | ○ | ○ | ○ | ○ | ○ | | | | | | | | | | | ○ | ○ | ○ | ○ | ○ |
| | | BEHIND | | | | | | | | | | | ○ | ○ | ○ | ○ | ○ | | | | | | | | | | |
| SURR. BACK | SIZE | LARGE | ○ | ○ | | | | ○ | ○ | | | | ○ | ○ | | | | ○ | ○ | | | | ○ | ○ | | | |
| | | SMALL | | | ○ | ○ | | | | ○ | ○ | | | | ○ | ○ | | | | ○ | ○ | | | | ○ | ○ | |
| | | NO | | | | | ○ | | | | | ○ | | | | | ○ | | | | | ○ | | | | | ○ |
| | HEIGHT | LOW | ○ | | ○ | | / | ○ | | ○ | | / | ○ | | ○ | | / | ○ | | ○ | | / | ○ | | ○ | | / |
| | | HIGH | | ○ | | ○ | / | | ○ | | ○ | / | | ○ | | ○ | / | | ○ | | ○ | / | | ○ | | ○ | / |
| | POSI | SIDE | | | | | / | | | | | / | | | | | / | | | | | / | | | | | / |
| | | MIDDLE | | | | | / | | | | | / | | | | | / | | | | | / | | | | | / |
| | | BEHIND | ○ | ○ | ○ | ○ | / | ○ | ○ | ○ | ○ | / | ○ | ○ | ○ | ○ | / | ○ | ○ | ○ | ○ | / | ○ | ○ | ○ | ○ | / |

| | | | 75 | 76 | 77 | 78 | 79 | 80 | 81 | 82 | 83 | 84 | 85 | 86 | 87 | 88 | 89 | 90 | 91 | 92 | 93 | 94 | 95 | 96 | 97 | 98 |
|---|---|---|---|---|---|---|---|---|---|---|---|---|---|---|---|---|---|---|---|---|---|---|---|---|---|---|
| FRONT | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | |
| CENTER | SIZE | LARGE | | | | | | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | NO | | | | | | | | | | | | | | | | | | | | | | | | |
| SURR. | SIZE | LARGE | ○ | ○ | ○ | ○ | ○ | | | | | | | | | | | | | | | | | | | |
| | | SMALL | | | | | | ○ | ○ | ○ | ○ | ○ | ○ | ○ | ○ | ○ | ○ | ○ | ○ | ○ | ○ | ○ | ○ | ○ | ○ | |
| | | NO | | | | | | | | | | | | | | | | | | | | | | | | ○ |
| | HEIGHT | LOW | | | | | | ○ | ○ | ○ | ○ | ○ | ○ | ○ | ○ | ○ | | | | | | | | | | / |
| | | HIGH | ○ | ○ | ○ | ○ | ○ | | | | | | | | | | ○ | ○ | ○ | ○ | ○ | ○ | ○ | ○ | ○ | / |
| | POSI | SIDE | | | | | | ○ | ○ | ○ | | | | | | | ○ | ○ | ○ | | | | | | | / |
| | | MIDDLE | | | | | | | | | ○ | ○ | ○ | | | | | | | ○ | ○ | ○ | | | | / |
| | | BEHIND | ○ | ○ | ○ | ○ | ○ | | | | | | | ○ | ○ | ○ | | | | | | | ○ | ○ | ○ | / |
| SURR. BACK | SIZE | LARGE | ○ | ○ | | | | | | | | | | | | | | | | | | | | | | / |
| | | SMALL | | | ○ | ○ | | ○ | ○ | | ○ | ○ | | ○ | ○ | | ○ | ○ | | ○ | ○ | | ○ | ○ | | / |
| | | NO | | | | | ○ | | | ○ | | | ○ | | | ○ | | | ○ | | | ○ | | | ○ | / |
| | HEIGHT | LOW | ○ | | ○ | | / | ○ | | / | ○ | | / | ○ | | / | ○ | | / | ○ | | / | ○ | | / | / |
| | | HIGH | | ○ | | ○ | / | | ○ | / | | ○ | / | | ○ | / | | ○ | / | | ○ | / | | ○ | / | / |
| | POSI | SIDE | | | | | / | | | / | | | / | | | / | | | / | | | / | | | / | / |
| | | MIDDLE | | | | | / | | | / | | | / | | | / | | | / | | | / | | | / | / |
| | | BEHIND | ○ | ○ | ○ | ○ | / | ○ | ○ | / | ○ | ○ | / | ○ | ○ | / | | ○ | / | ○ | ○ | / | ○ | ○ | / | / |

Fig. 6

| | | | 99 | 100 | 101 | 102 | 103 | 104 | 105 | 106 | 107 | 108 | 109 | 110 | 111 | 112 | 113 | 114 | 115 | 116 | 117 | 118 | 119 | 120 | 121 | 122 | 123 |
|---|---|---|---|---|---|---|---|---|---|---|---|---|---|---|---|---|---|---|---|---|---|---|---|---|---|---|---|
| FRONT | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| CENTER | SIZE | LARGE | | | | | | | | | | | | | | | | | | | | | | | | | |
| | | SMALL | | | | | | | | | | | | | | | | | | | | | | | | | |
| | | NO | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| SURR. | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | | |
| | | NO | | | | | | | | | | | | | | | | | | | | | | | | | |
| | HEIGHT | LOW | ○ | ○ | ○ | ○ | ○ | ○ | ○ | ○ | ○ | ○ | ○ | ○ | ○ | ○ | ○ | | | | | | | | | | |
| | | HIGH | | | | | | | | | | | | | | | | ○ | ○ | ○ | ○ | ○ | ○ | ○ | ○ | ○ | ○ |
| | POSI | SIDE | ○ | ○ | ○ | ○ | ○ | | | | | | | | | | | ○ | ○ | ○ | ○ | ○ | | | | | |
| | | MIDDLE | | | | | | ○ | ○ | ○ | ○ | ○ | | | | | | | | | | | ○ | ○ | ○ | ○ | ○ |
| | | BEHIND | | | | | | | | | | | ○ | ○ | ○ | ○ | ○ | | | | | | | | | | |
| SURR. BACK | SIZE | LARGE | ○ | ○ | | | | ○ | ○ | | | | ○ | ○ | | | | ○ | ○ | | | | ○ | ○ | | | |
| | | SMALL | | | ○ | ○ | | | | ○ | ○ | | | | ○ | ○ | | | | ○ | ○ | | | | ○ | ○ | |
| | | NO | | | | | ○ | | | | | ○ | | | | | ○ | | | | | ○ | | | | | ○ |
| | HEIGHT | LOW | ○ | | ○ | | ／ | ○ | | ○ | | ／ | ○ | | ○ | | ／ | ○ | | ○ | | ／ | ○ | | ○ | | ／ |
| | | HIGH | | ○ | | ○ | ／ | | ○ | | ○ | ／ | | ○ | | ○ | ／ | | ○ | | ○ | ／ | | ○ | | ○ | ／ |
| | POSI | SIDE | | | | | ／ | | | | | ／ | | | | | ／ | | | | | ／ | | | | | ／ |
| | | MIDDLE | | | | | ／ | | | | | ／ | | | | | ／ | | | | | ／ | | | | | ／ |
| | | BEHIND | ○ | ○ | ○ | ○ | ／ | ○ | ○ | ○ | ○ | ／ | ○ | ○ | ○ | ○ | ／ | ○ | ○ | ○ | ○ | ／ | ○ | ○ | ○ | ○ | ／ |

| | | | 124 | 125 | 126 | 127 | 128 | 129 | 130 | 131 | 132 | 133 | 134 | 135 | 136 | 137 | 138 | 139 | 140 | 141 | 142 | 143 | 144 | 145 | 146 | 147 |
|---|---|---|---|---|---|---|---|---|---|---|---|---|---|---|---|---|---|---|---|---|---|---|---|---|---|---|
| FRONT | SIZE | LARGE | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | SMALL | | | | | | | | | | | | | | | | | | | | | | | | |
| CENTER | SIZE | LARGE | | | | | | | | | | | | | | | | | | | | | | | | |
| | | SMALL | | | | | | | | | | | | | | | | | | | | | | | | |
| | | NO | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| SURR. | SIZE | LARGE | ○ | ○ | ○ | ○ | ○ | | | | | | | | | | | | | | | | | | | |
| | | SMALL | | | | | | ○ | ○ | ○ | ○ | ○ | ○ | ○ | ○ | ○ | ○ | ○ | ○ | ○ | ○ | ○ | ○ | ○ | ○ | |
| | | NO | | | | | | | | | | | | | | | | | | | | | | | | ○ |
| | HEIGHT | LOW | | | | | | ○ | ○ | ○ | ○ | ○ | ○ | ○ | ○ | ○ | | | | | | | | | | ／ |
| | | HIGH | ○ | ○ | ○ | ○ | ○ | | | | | | | | | | ○ | ○ | ○ | ○ | ○ | ○ | ○ | ○ | ○ | ／ |
| | POSI | SIDE | | | | | | ○ | ○ | ○ | | | | | | | ○ | ○ | ○ | | | | | | | ／ |
| | | MIDDLE | | | | | | | | | ○ | ○ | ○ | | | | | | | ○ | ○ | ○ | | | | ／ |
| | | BEHIND | ○ | ○ | ○ | ○ | ○ | | | | | | | ○ | ○ | ○ | | | | | | | ○ | ○ | ○ | ／ |
| SURR. BACK | SIZE | LARGE | ○ | ○ | | | | | | | | | | | | | | | | | | | | | | ／ |
| | | SMALL | | | ○ | ○ | | ○ | ○ | | ○ | ○ | | ○ | ○ | | ○ | ○ | | ○ | ○ | | ○ | ○ | | ／ |
| | | NO | | | | | ○ | | | ○ | | | ○ | | | ○ | | | ○ | | | ○ | | | ○ | ／ |
| | HEIGHT | LOW | ○ | | ○ | | ／ | ○ | | ／ | ○ | | ／ | ○ | | ／ | ○ | | ／ | ○ | | ／ | ○ | | ／ | ／ |
| | | HIGH | | ○ | | ○ | ／ | | ○ | ／ | | ○ | ／ | | ○ | ／ | | ○ | ／ | | ○ | ／ | | ○ | ／ | ／ |
| | POSI | SIDE | | | | | ／ | | | ／ | | | ／ | | | ／ | | | ／ | | | ／ | | | ／ | ／ |
| | | MIDDLE | | | | | ／ | | | ／ | | | ／ | | | ／ | | | ／ | | | ／ | | | ／ | ／ |
| | | BEHIND | ○ | ○ | ○ | ○ | ／ | ○ | ○ | ／ | ○ | ○ | ／ | ○ | ○ | ／ | | ○ | ／ | ○ | ○ | ／ | ○ | ○ | ／ | ／ |

Fig. 7

| | | | 178 | 179 | 180 | 181 | 182 | 183 | 184 | 185 | 186 | 187 | 188 | 189 | 190 | 191 | 192 | 193 | 194 | 195 | 196 |
|---|---|---|---|---|---|---|---|---|---|---|---|---|---|---|---|---|---|---|---|---|---|
| FRONT | SIZE | LARGE | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | ○ |
| CENTER | SIZE | LARGE | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | ○ |
| | | NO | | | | | | | | | | | | | | | | | | | |
| SURR. | SIZE | LARGE | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | |
| | | NO | | | | | | | | | | | | | | | | | | | ○ |
| | HEIGHT | LOW | ○ | ○ | ○ | ○ | ○ | ○ | ○ | ○ | ○ | | | | | | | | | | ／ |
| | | HIGH | | | | | | | | | | ○ | ○ | ○ | ○ | ○ | ○ | ○ | ○ | ○ | ／ |
| | POSI | SIDE | ○ | ○ | ○ | | | | | | | ○ | ○ | ○ | | | | | | | ／ |
| | | MIDDLE | | | | ○ | ○ | ○ | | | | | | | ○ | ○ | ○ | | | | ／ |
| | | BEHIND | | | | | | | ○ | ○ | ○ | | | | | | | ○ | ○ | ○ | ／ |
| SURR. BACK | SIZE | LARGE | | | | | | | | | | | ○ | ○ | | | | ○ | ○ | | ／ |
| | | SMALL | ○ | ○ | | ○ | ○ | | ○ | ○ | | ○ | ○ | | ○ | ○ | | ○ | ○ | | ／ |
| | | NO | | | ○ | | | ○ | | | ○ | | | ○ | | | ○ | | | ○ | ／ |
| | HEIGHT | LOW | ○ | | ／ | ○ | | ／ | ○ | | ／ | ○ | | ／ | ○ | | ／ | ○ | | ／ | ／ |
| | | HIGH | | ○ | ／ | | ○ | ／ | | ○ | ／ | | ○ | ／ | | ○ | ／ | | ○ | ／ | ／ |
| | POSI | SIDE | | | ／ | | | ／ | | | ／ | | | ／ | | | ／ | | | ／ | ／ |
| | | MIDDLE | | | ／ | | | ／ | | | ／ | | | ／ | | | ／ | | | ／ | ／ |
| | | BEHIND | ○ | ○ | ／ | ○ | ○ | ／ | ○ | ○ | ／ | | ○ | ／ | ○ | ○ | ／ | ○ | ○ | ／ | ／ |

| | | | 178 | 179 | 180 | 181 | 182 | 183 | 184 | 185 | 186 | 187 | 188 | 189 | 190 | 191 | 192 | 193 | 194 | 195 | 196 |
|---|---|---|---|---|---|---|---|---|---|---|---|---|---|---|---|---|---|---|---|---|---|
| FRONT | SIZE | LARGE | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | ○ |
| CENTER | SIZE | LARGE | | | | | | | | | | | | | | | | | | | |
| | | SMALL | | | | | | | | | | | | | | | | | | | |
| | | NO | ○ | ○ | ○ | ○ | ○ | ○ | ○ | ○ | ○ | ○ | ○ | ○ | ○ | ○ | ○ | ○ | ○ | ○ | ○ |
| SURR. | SIZE | LARGE | | | | | | | | | | | | | | | | | | | |
| | | SMALL | ○ | ○ | ○ | ○ | ○ | ○ | ○ | ○ | ○ | ○ | ○ | ○ | ○ | ○ | ○ | ○ | ○ | ○ | |
| | | NO | | | | | | | | | | | | | | | | | | | ○ |
| | HEIGHT | LOW | ○ | ○ | ○ | ○ | ○ | ○ | ○ | ○ | ○ | | | | | | | | | | ／ |
| | | HIGH | | | | | | | | | | ○ | ○ | ○ | ○ | ○ | ○ | ○ | ○ | ○ | ／ |
| | POSI | SIDE | ○ | ○ | ○ | | | | | | | ○ | ○ | ○ | | | | | | | ／ |
| | | MIDDLE | | | | ○ | ○ | ○ | | | | | | | ○ | ○ | ○ | | | | ／ |
| | | BEHIND | | | | | | | ○ | ○ | ○ | | | | | | | ○ | ○ | ○ | ／ |
| SURR. BACK | SIZE | LARGE | | | | | | | | | | | ○ | ○ | | | | ○ | ○ | | ／ |
| | | SMALL | ○ | ○ | | ○ | ○ | | ○ | ○ | | ○ | ○ | | ○ | ○ | | ○ | ○ | | ／ |
| | | NO | | | ○ | | | ○ | | | ○ | | | ○ | | | ○ | | | ○ | ／ |
| | HEIGHT | LOW | ○ | | ／ | ○ | | ／ | ○ | | ／ | ○ | | ／ | ○ | | ／ | ○ | | ／ | ／ |
| | | HIGH | | ○ | ／ | | ○ | ／ | | ○ | ／ | | ○ | ／ | | ○ | ／ | | ○ | ／ | ／ |
| | POSI | SIDE | | | ／ | | | ／ | | | ／ | | | ／ | | | ／ | | | ／ | ／ |
| | | MIDDLE | | | ／ | | | ／ | | | ／ | | | ／ | | | ／ | | | ／ | ／ |
| | | BEHIND | ○ | ○ | ／ | ○ | ○ | ／ | ○ | ○ | ／ | | ○ | ／ | ○ | ○ | ／ | ○ | ○ | ／ | ／ |

| PATTERN NUMBER | FRONT | CENTER | REAR | SUB WOOFER |
|---|---|---|---|---|
| 1 | LARGE | LARGE | LARGE | YES |
| 2 | LARGE | LARGE | SMALL | YES |
| 3 | ⋮ | ⋮ | ⋮ | ⋮ |

(RETURN TO NORMAL DISPLAY MODE)

Fig. 29

| NUMBER | | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|---|
| PATTERN NUMBER | | 7-1 | 7-0 | 6-1 | 6-0 | 5-1 | 5-0 | 7-1 | 7-0 | 6-1 | 6-0 | 5-1 | 5-0 | 3-1 | 3-0 | 7-1 | 7-0 | 6-1 | 6-0 | 5-1 | 5-0 | 7-1 | 7-0 | 6-1 | 6-0 | 5-1 |
| SPEAKERS | FL,FR | L | L | L | L | L | L | L | L | L | L | L | L | L | L | L | L | L | L | L | L | L | L | L | L | L |
| | C | L | L | L | L | L | L | L | L | L | L | L | L | L | L | S | S | S | S | S | S | S | S | S | S | S |
| | SL,SR | L | L | L | L | L | L | S | S | S | S | S | S | No | No | L | L | L | L | L | L | S | S | S | S | S |
| | SBL,SBR | D | D | Sg | Sg | No | No | D | D | Sg | Sg | No | No | No | No | D | D | Sg | Sg | No | No | D | D | Sg | Sg | No |
| | SW | Yes | No | Yes | No | Yes | No | Yes | No | Yes | No | Yes | No | Yes | No | Yes | No | Yes | No | Yes | No | Yes | No | Yes | No | Yes |

| NUMBER | | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 |
|---|---|---|---|---|---|---|---|---|---|---|---|---|---|---|---|---|---|---|---|---|---|---|---|---|---|---|
| PATTERN NUMBER | | 5-0 | 3-1 | 3-0 | 6C1 | 6C0 | 5C1 | 5C0 | 4C1 | 4C0 | 6C1 | 6C0 | 5C1 | 5C0 | 4C1 | 4C0 | 2-1 | 2-0 | 7-1 | 6-1 | 5-1 | 3-1 | 6C1 | 5C1 | 4C1 | 2-1 |
| SPEAKERS | FL,FR | L | L | L | L | L | L | L | L | L | L | L | L | L | L | L | L | L | S | S | S | S | S | S | S | S |
| | C | S | S | S | No | No | No | No | No | No | No | No | No | No | No | No | No | No | S | S | S | S | No | No | No | No |
| | SL,SR | S | No | No | L | L | L | L | L | L | S | S | S | S | S | S | No | No | S | S | S | No | S | S | S | No |
| | SBL,SBR | No | No | No | D | D | Sg | Sg | No | No | D | D | Sg | Sg | No | No | No | No | D | Sg | No | No | D | Sg | No | No |
| | SW | No | Yes | No | Yes | No | Yes | No | Yes | No | Yes | No | Yes | No | Yes | No | Yes | No | Yes | Yes | Yes | Yes | Yes | Yes | Yes | Yes |

[XXX]=YES/NO

Fig. 33

| | FL | FR | C | SL | SR | SBL | SBR | SW | THE NUMBER OF SPEAKERS BEFORE DELETION | THE NUMBER OF SPEAKERS AFTER DELETION |
|---|---|---|---|---|---|---|---|---|---|---|
| 1 | L | L | L | L | L | L | L | ○ | 8 | 8 |
| 2 | L | L | L | L | L | S | S | ○ | 8 | |
| 3 | L | L | L | S | S | L | L | ○ | 8 | |
| 4 | L | L | L | S | S | S | S | ○ | 8 | 8 |
| 5 | L | L | S | L | L | L | L | ○ | 8 | 8 |
| 6 | L | L | S | L | L | S | S | ○ | 8 | |
| 7 | L | L | S | S | S | L | L | ○ | 8 | |
| 8 | L | L | S | S | S | S | S | ○ | 8 | 8 |
| 9 | S | S | S | S | S | S | S | ○ | 8 | 8 |
| 10 | L | L | — | L | L | L | L | ○ | 7 | 7 |
| 11 | L | L | — | L | L | S | S | ○ | 7 | |
| 12 | L | L | — | S | S | L | L | ○ | 7 | |
| 13 | L | L | — | S | S | S | S | ○ | 7 | 7 |
| 14 | S | S | — | S | S | S | S | ○ | 7 | 7 |
| 15 | L | L | M | L | L | L | L | ○ | 7 | 7 |
| 16 | L | L | M | S | S | L | L | ○ | 7 | |
| 17 | L | L | M | L | L | S | S | ○ | 7 | |
| 18 | L | L | M | S | S | S | S | ○ | 7 | 7 |
| 19 | S | S | M | S | S | S | S | ○ | 7 | 7 |
| 20 | L | L | L | L | L | L | L | — | 7 | 7 |
| 21 | L | L | L | L | L | S | S | — | 7 | |
| 22 | L | L | L | S | S | L | L | — | 7 | |
| 23 | L | L | L | S | S | S | S | — | 7 | 7 |
| 24 | L | L | S | L | L | L | L | — | 7 | 7 |
| 25 | L | L | S | L | L | S | S | — | 7 | |
| 26 | L | L | S | S | S | L | L | — | 7 | |
| 27 | L | L | S | S | S | S | S | — | 7 | 7 |
| 28 | S | S | S | S | S | S | S | — | 7 | |
| 29 | L | L | — | L | L | L | L | — | 6 | 6 |
| 30 | L | L | — | L | L | S | S | — | 6 | |
| 31 | L | L | — | S | S | L | L | — | 6 | |
| 32 | L | L | — | S | S | S | S | — | 6 | 6 |
| 33 | S | S | — | S | S | S | S | — | 6 | |
| 34 | L | L | M | L | L | L | L | — | 6 | 6 |
| 35 | L | L | M | S | S | L | L | — | 6 | |
| 36 | L | L | M | L | L | S | S | — | 6 | |
| 37 | L | L | M | S | S | S | S | — | 6 | 6 |
| 38 | S | S | M | S | S | S | S | — | 6 | |

Fig. 34

| | FL | FR | C | SL | SR | SBL,SBR | SW | THE NUMBER OF SPEAKERS | |
|---|---|---|---|---|---|---|---|---|---|
| | | | | | | | | BEFORE DELETION | AFTER DELETION |
| 39 | L | L | L | L | L | L | ○ | 7 | 7 |
| 40 | L | L | L | L | L | S | ○ | 7 | |
| 41 | L | L | L | S | S | L | ○ | 7 | |
| 42 | L | L | L | S | S | S | ○ | 7 | 7 |
| 43 | L | L | S | L | L | L | ○ | 7 | 7 |
| 44 | L | L | S | L | L | S | ○ | 7 | |
| 45 | L | L | S | S | S | L | ○ | 7 | |
| 46 | L | L | S | S | S | S | ○ | 7 | 7 |
| 47 | S | S | S | S | S | S | ○ | 7 | 7 |
| 48 | L | L | — | L | L | L | ○ | 6 | 6 |
| 49 | L | L | | L | L | S | ○ | 6 | |
| 50 | L | L | | S | S | L | ○ | 6 | |
| 51 | L | L | — | S | S | S | ○ | 6 | 6 |
| 52 | S | S | — | S | S | S | ○ | 6 | 6 |
| 53 | L | L | M | L | L | — | ○ | 5 | 5 |
| 54 | L | L | M | S | S | — | ○ | 5 | 5 |
| 55 | L | L | M | — | — | — | ○ | 3 | 3 |
| 56 | L | L | M | L | L | L | ○ | 6 | 6 |
| 57 | L | L | M | S | S | L | ○ | 6 | |
| 58 | L | L | M | L | L | S | ○ | 6 | |
| 59 | L | L | M | S | S | S | ○ | 6 | 6 |
| 60 | L | L | M | L | L | — | — | 4 | 4 |
| 61 | L | L | M | S | S | — | — | 4 | 4 |
| 62 | L | L | M | — | — | — | — | 2 | 2 |
| 63 | L | L | L | L | L | L | — | 6 | 6 |
| 64 | L | L | L | L | L | S | | 6 | |
| 65 | L | L | L | S | S | L | | 6 | |
| 66 | L | L | L | S | S | S | — | 6 | 6 |
| 67 | L | L | S | L | L | L | — | 6 | 6 |
| 68 | L | L | S | L | L | S | | 6 | |
| 69 | L | L | S | S | S | L | | 6 | |
| 70 | L | L | S | S | S | S | — | 6 | 6 |

Fig. 35

| | FL | FR | C | SL | SR | SBL,SBR | SW | THE NUMBER OF SPEAKERS | |
|---|---|---|---|---|---|---|---|---|---|
| | | | | | | | | BEFORE DELETION | AFTER DELETION |
| 71 | S | S | S | S | S | S | | 6 | |
| 72 | L | L | — | L | L | L | — | 5 | 5 |
| 73 | L | L | | L | L | S | | 5 | |
| 74 | L | L | | S | S | L | | 5 | |
| 75 | L | L | — | S | S | S | — | 5 | 5 |
| 76 | S | S | | S | S | S | | 5 | |
| 77 | S | S | M | S | S | — | ○ | 5 | 5 |
| 78 | S | S | M | | — | — | ○ | 3 | 3 |
| 79 | S | S | M | S | S | S | ○ | 6 | 6 |
| 80 | S | S | M | S | S | | | 4 | |
| 81 | S | S | M | | | | | 2 | |
| 82 | S | S | M | S | S | S | | 5 | |
| 83 | L | L | M | L | L | L | — | 5 | 5 |
| 84 | L | L | M | S | S | L | | 5 | |
| 85 | L | L | M | L | L | S | | 5 | |
| 86 | L | L | M | S | S | S | — | 5 | 5 |
| 87 | S | S | — | S | S | — | ○ | 5 | 5 |
| 88 | S | S | — | | — | — | ○ | 3 | 3 |
| 89 | L | L | — | S | S | — | ○ | 5 | 5 |
| 90 | L | L | — | L | L | — | ○ | 5 | 5 |
| 91 | L | L | — | | — | — | ○ | 3 | 3 |
| 92 | L | L | L | L | L | — | ○ | 6 | 6 |
| 93 | L | L | L | S | S | — | ○ | 6 | 6 |
| 94 | L | L | S | L | L | — | ○ | 6 | 6 |
| 95 | L | L | S | S | S | — | ○ | 6 | 6 |
| 96 | S | S | S | S | S | — | ○ | 6 | 6 |
| 97 | L | L | L | | — | — | ○ | 4 | 4 |
| 98 | L | L | S | | — | — | ○ | 4 | 4 |
| 99 | S | S | S | | — | — | ○ | 4 | 4 |
| 100 | S | S | | S | S | | | 4 | |
| 101 | S | S | | | | | | 2 | |
| 102 | L | L | — | S | S | — | — | 4 | 4 |
| 103 | L | L | — | L | L | — | — | 4 | 4 |
| 104 | L | L | — | | — | — | — | 2 | 2 |
| 105 | L | L | L | L | L | — | — | 5 | 5 |
| 106 | L | L | L | S | S | — | — | 5 | 5 |
| 107 | L | L | S | L | L | — | — | 5 | 5 |
| 108 | L | L | S | S | S | — | — | 5 | 5 |
| 109 | S | S | S | S | S | | | 5 | |
| 110 | L | L | L | | — | — | — | 3 | 3 |
| 111 | L | L | S | | — | — | — | 3 | 3 |
| 112 | S | S | S | | | | | 3 | |

Fig. 36A

| | | |

Fig. 40A

| | | | |
|---|---|---|---|
| SUB WOOFER | [ ][ ][x][x][x][ ][ ][ ] | x: NO,YES | LIGHT ON CHARACTERS OF SW, FLICKER FRAME |

Fig. 40B

| | | | |
|---|---|---|---|
| FRONT SPEAKERS | [ ][ ][x][x][x][x][x][ ] | x: SMALL,LARGE | LIGHT ON CHARACTERS OF L AND R, FLICKER FRAME |

Fig. 40C

| | | | |
|---|---|---|---|
| CENTER SPEAKERS | [ ][ ][x][x][x][x][x][ ] | x: NO,SMALL,LARGE | LIGHT ON CHARACTERS OF C, FLICKER FRAME |

Fig. 40D

| | | | |
|---|---|---|---|
| SURR SPEAKERS | [ ][ ][x][x][x][x][x][ ] | x: NO,SMALL,LARGE | LIGHT ON CHARACTERS OF SL AND SR, FLICKER FRAME |

Fig. 40E

| | | | |
|---|---|---|---|
| SB SPEAKERS | [ ][x][x][x][x][x][x][ ] | x: NO,SINGLE,DUAL | LIGHT ON CHARACTERS OF SB, FLICKER FRAME |

ACOUSTIC APPARATUS AND ACOUSTIC SETTING METHOD

BACKGROUND OF THE INVENTION

1. Field of the Invention

The invention relates to a setting method and an acoustic apparatus, in which when a number of speakers for constructing a sound field are connected, an acoustic setup for the speakers which are connected can be easily made.

2. Description of the Related Arts

Hitherto, for example, in a movie theater or the like, in order to provide a three-dimensional sound field to the listener, what is called a surround system in which speakers are arranged not only in the front right and left positions of the listener but also in the front center position and the rear right and left positions of the listener and, further, a sub woofer for exclusively reproducing a mid-bass sound is arranged has been used. In the case of such a speaker layout, since a band width of a signal which is supplied to the sub woofer is almost equal to 1/10 of that of each of signals which are supplied to the other speakers, such a surround system is called "5.1ch surround" (abbreviated to "5.1ch") or the like.

In recent years, in association with the realization of a large display screen of a display apparatus, the realization of high picture quality of a video reproducing system, the realization of broadcasting by multichannel audio sounds such as BS (Broadcasting Satellite) digital broadcasting, or the like, such a multichannel surround system has been also used at home. In the case of realizing the multichannel surround system at home, what is called an AV (Audio Video) acoustic apparatus (an AV amplifier, an AV receiver obtained by providing a tuner function for the AV amplifier, or the like) which is constructed by providing multichannel speaker outputs for one audio amplifier and corresponds to inputs of multichannel audio signals is frequently used.

Such a technique that when audio sounds are reproduced in multichannel like BS digital broadcasting, the user is visually notified of an audio mode in which sounds are at present being reproduced has been disclosed in JP-A-2002-221928.

When an AV acoustic apparatus having such a multichannel reproducing function as mentioned above is used, a speaker setup is certainly necessary as initial setting. As a multichannel reproducing system which is generally used, the foregoing 5.1ch surround system exists. This is mainly because an audio format of a DVD (Digital Versatile Disc) video is a 5.1ch surround format. In the 5.1ch surround system, six speakers comprising left and right front speakers (referred to as FL and FR), a center speaker (referred to as C), left and right surround speakers (referred to as SL and SR), and a sub woofer (referred to as SW) are used. Ordinarily, for the listener, the speakers FL and FR are arranged in the front left and right positions, the speaker C is arranged in the front center position, the surround speakers SL and SR are arranged in the left and right positions or the rear left and right positions, and the speaker SW is arranged in an arbitrary position, respectively.

In recent years, there is also an AV acoustic apparatus corresponding, by the standards, to a surround back speaker (referred to as SB) for reproduction of 6.1ch such as "DOLBY DIGITAL EX" (registered trademark), "dts-ES" (registered trademark), or the like. Further, an AV acoustic apparatus corresponding to a system of 7.1ch in which two surround back speakers (referred to as SBL and SBR) are arranged in the rear left and right positions of the listener or a system of 9.1ch in which four surround speakers (referred to as SL1, SL2, SR1, and SR2) are arranged, or the like also exists.

When an AV acoustic apparatus in which a number of speakers are connected in accordance with each application and sounds are reproduced as mentioned above is used, the user needs to perform a setup for the speakers which are connected. Such a speaker setup is performed every channel of the speakers which are connected to the AV acoustic apparatus with respect to items such as presence/absence, large/small (whether the speaker is used for full-range reproduction or mid-high band reproduction), and the like of the speakers which are connected. If necessary, a sound volume and a sound quality balance of each speaker in the AV acoustic apparatus, delay time of an audio signal output for constructing a surround environment, and the like are set. Therefore, if such a setup is not performed in accordance with a construction of the speakers which have actually been arranged, the optimum multichannel reproducing environment cannot be constructed.

However, the above speaker setup has such a problem that since a state is determined every arranged speaker, a number of items have to be set one by one and it is very troublesome to the user.

As the number of channels increases like 2ch<5.1ch<6.1ch<7.1ch<9.1ch, the number of items and patterns to be set also increase. Such a setting operation is difficult for the user in a manner similar to the connection of the speakers and other apparatuses, or the like. There is also such a problem that since a user interface is ordinarily limited for the AV acoustic apparatus, in the case of setting a number of items as mentioned above, the setting operation often becomes complicated and cannot be easily executed by everyone.

OBJECTS AND SUMMARY OF THE INVENTION

It is, therefore, an object of the invention to provide an acoustic setting method and an acoustic apparatus which can easily execute setting operation of each speaker for a number of connected speakers.

To solve the foregoing problems, according to the invention, there is provided an acoustic apparatus to which three or more speakers can be connected and which can reproduce surround sounds, comprising: output control means for controlling audio signal outputs of a plurality of channels every plurality of channels; a table for storing each of speaker constructions which can be constructed by a plurality of channels and identification codes for identifying the speaker constructions in correspondence to each other; operating means for selecting the identification code in accordance with an operation; and display means for displaying the identification code selected by the operating means, wherein the apparatus has a batch setup mode in which the control by the output control means is set on the basis of the speaker construction corresponding to the selected identification code with reference to the table on the basis of the identification code selected by the operating means.

There is also provided an acoustic setting method of performing an acoustic setup of each of speakers connected to an acoustic apparatus to which three or more speakers can be connected and which can reproduce surround sounds, comprising: an output control step of controlling audio signal outputs of a plurality of channels every plurality of channels; an operating step of selecting an identification code in accordance with an operation from a table, in which the identification code corresponds to each of speaker setups which can be constructed by a plurality of channels and is used for identifying the speaker setup; and a displaying step of displaying the identification code selected by the operating step, wherein the method has a batch setup mode for controlling the output control step on the basis of the speaker setup corresponding to the selected identification code with reference to the table on the basis of the identification code selected in the operating step.

According to the invention as mentioned above, each of the speaker constructions which can be constructed by a plurality of channels and the identification code for identifying the speaker construction are stored in the table in correspondence to each other, the identification code is selected and displayed in accordance with the operation, and the audio signal outputs of a plurality of channels are controlled every channel on the basis of the speaker construction obtained by referring to the table on the basis of the selected identification code. Therefore, the control of the audio signal outputs of every channel can be made in a lump merely by selecting the identification code on the basis of the display.

The above and other objects and features of the present invention will become apparent from the following detailed description and the appended claims with reference to the accompanying drawings.

BRIEF DESCRIPTION OF THE DRAWINGS

FIG. 2 is a schematic diagram showing an example of kinds of patterns which can be constructed in the AV acoustic apparatus;

FIG. 3 is a schematic diagram showing an example of kinds of patterns which can be constructed in the AV acoustic apparatus;

FIG. 4 is a schematic diagram showing a reference example of kinds of patterns which can be constructed in the AV acoustic apparatus;

FIG. 5 is a schematic diagram showing a reference example of kinds of patterns which can be constructed in the AV acoustic apparatus;

FIG. 6 is a schematic diagram showing a reference example of kinds of patterns which can be constructed in the AV acoustic apparatus;

FIG. 7 is a schematic diagram showing a reference example of kinds of patterns which can be constructed in the AV acoustic apparatus;

FIG. 29 is a schematic diagram showing a correspondence example of the pattern number and a combination of speakers;

FIG. 33 is a schematic diagram showing a list of patterns of the speaker setup in the case where it can correspond up to a 7.1ch system;

FIG. 34 is a schematic diagram showing a list of patterns of the speaker setup in the case where it can correspond up to the 7.1ch system;

FIG. 35 is a schematic diagram showing a list of patterns of the speaker setup in the case where it can correspond up to the 7.1ch system;

FIGS. 36A to 36E are schematic diagrams each showing a display of an example of a display device at the time of a normal setup;

FIGS. 40A to 40E are diagrams for explaining the setting operation of an example using the display which can display 8 characters.

DETAILED DESCRIPTION OF THE PREFERRED EMBODIMENT

An embodiment of the invention will now be described hereinbelow. In the invention, a layout of speakers which can be constructed is patterned and is previously registered into an AV acoustic apparatus in correspondence to a simple name. By simply selecting the construction corresponding to the actual layout from the registered patterns, the user can perform a speaker setup in the AV acoustic apparatus.

Figure 1:
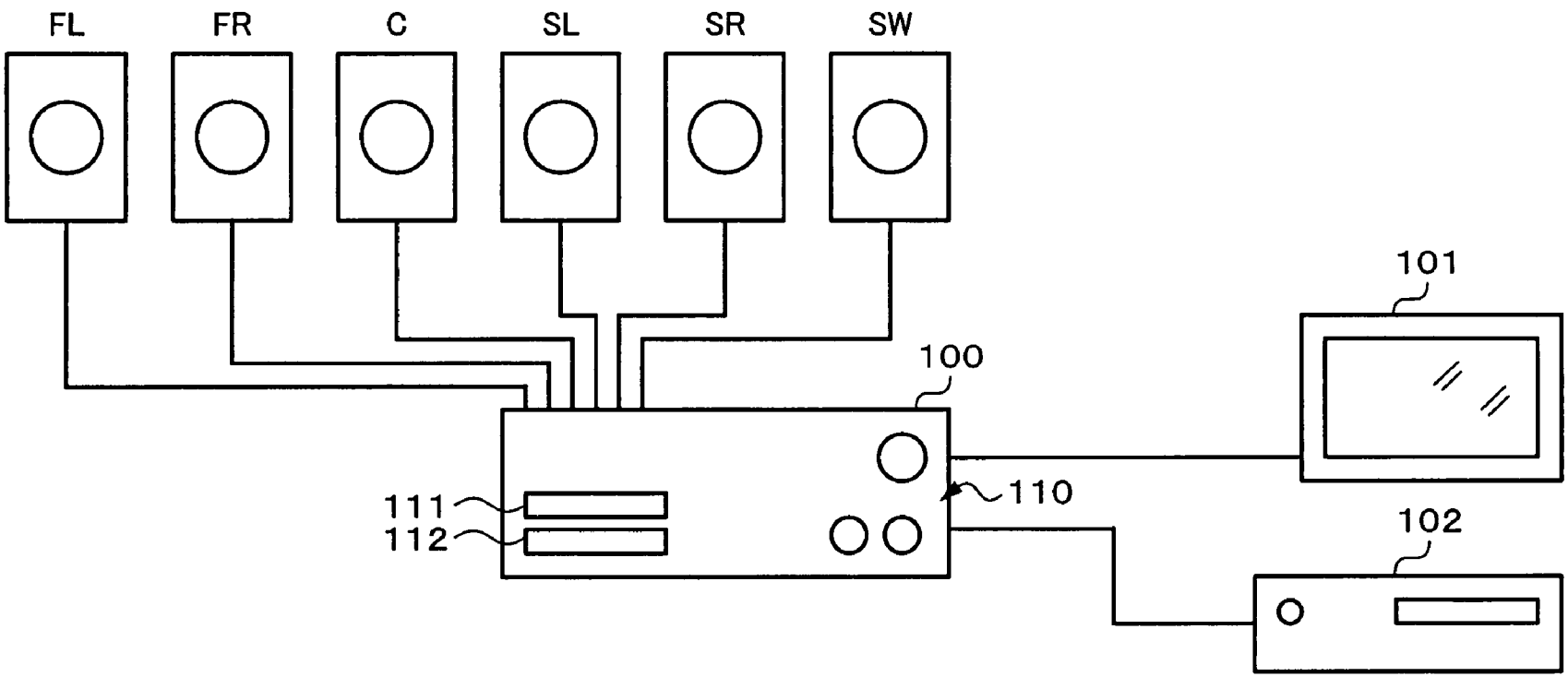
FIG. 1 is a schematic diagram showing connection of an example of an AV acoustic apparatus.

FIG. 1 shows a connection of an example of an AV acoustic apparatus 100. It is assumed here that the AV acoustic apparatus 100 corresponds to the 5.1ch system. In the AV acoustic apparatus 100, an operation unit 110 for executing a volume operation, an input switching, or the like is provided on a front panel. The AV acoustic apparatus 100 has: a display unit 111 for displaying various setting contents or the like of the AV acoustic apparatus 100; and a setting operation unit 112 for performing various setups. The display unit 111 has, for example, one to a few lines on each of which a few to ten and a few characters can be displayed.

The AV acoustic apparatus 100 corresponds to the 5.1ch system and six speakers FL, FR, C, SL, SR, and SW can be connected. The speakers FL and FR are the left and right front speakers. The speaker C is the center speaker. The speakers SL and SR are the left and right surround speakers. The speaker SW is the sub woofer speaker.

For example, a DVD (Digital Versatile Disc) player 102 is connected as an AV reproducing apparatus to the AV acoustic apparatus 100. A video monitor apparatus 101 is connected to the AV acoustic apparatus 100. A video signal reproduced by the DVD player 102 is supplied to the video monitor apparatus 101 through the AV acoustic apparatus 100 and displayed on a display screen. An audio signal reproduced by the DVD player 102 is supplied to the AV acoustic apparatus 100, subjected to predetermined processes, and supplied to the connected speakers FL, FR, C, SL, SR, and SW, so that audio sounds are generated. By properly arranging the speakers FL, FR, C, SL, SR, and SW, the user can enjoy surround sounds.

In such a system, to comfortably enjoy the surround sounds, the user needs to perform the speaker setup to the AV acoustic apparatus 100 in accordance with the construction (layout, connecting form, and the like) of the speakers FL, FR, C, SL, SR, and SW. The AV acoustic apparatus 100 according to the embodiment has a memory therein and speaker settings according to combination patterns of the speakers which can be constructed have previously been stored in the memory. Prior to performing the speaker setup to the AV acoustic apparatus 100, the user needs to recognize which one of the patterns previously registered in the AV acoustic apparatus 100 the speaker construction of his own system coincides with or recognize to which pattern his own speaker construction is close. By operating the setting operation unit 112 on the basis of contents displayed on the display unit 111, the user can select the construction which coincides with or is close to the speaker construction of his own system from the patterns stored in the memory and perform the speaker setup.

Kinds of patterns which can be constructed in the AV acoustic apparatus will now be considered with respect to the 5.1ch system as an example. In the 5.1ch system, the left and right front speakers FL and FR, the center speaker C, the left and right surround speakers SL and SR, and the sub woofer SW can be connected. The 5.1ch system is constructed by connecting all of those speakers. The 5.1ch system can be also used without connecting all of those speakers. In this case, the signals in the channels to which the non-connected speakers correspond are ignored or the acoustic sounds of the non-connected speakers are compensated by using the connected speakers by acoustic processes in the AV acoustic apparatus 100.

With respect to each speaker, a size is defined in association with a reproducing band. For example, the speaker for full-range reproduction is assumed to be a large (LARGE) speaker and the speaker for a mid-high band reproduction is assumed to be a small (SMALL) speaker.

When the system is constructed, the following two limitations are provided in consideration of more actual use.

1. A construction without the left and right front speakers FL and FR cannot be selected.
2. When the front speakers FL and FR are small, large speakers cannot be selected as a center speaker C and surround speakers SL and SR.

When considering those two conditions, first, as shown in FIG. 2, 8 patterns exist as patterns of the speaker construction depending on the presence or absence of the front speakers FL and FR, the center speaker C, the surround speakers SL and SR, and the sub woofer SW.

Further, as shown in FIG. 3, 26 patterns exist as patterns of the speaker construction depending on the sizes of the front speakers FL and FR and the presence or absence and the sizes of the center speaker C and the surround speakers SL and SR. In FIG. 3, the speaker constructions which do not satisfy the above two conditions, that is, the speaker constructions which cannot be selected are shown as hatched regions.

An identification code (hereinafter, also referred to as an ID code) to identify the pattern is added to each pattern. As such ID codes, names which are unique to the patterns, numbers such as "1", "2", "3", . . . , or symbols such as "A", "B", "C", . . . can be used so long as they can discriminate the patterns. The ID code added to each pattern is referred to as a pattern number hereinbelow. When the number of characters which can be displayed on the display unit of the AV acoustic apparatus 100 is limited to about a few characters, it is desirable to indicate the pattern number by the symbol or number because the display unit can be effectively used.

The invention is not limited to such an example but the pattern number can be constructed by, for example, a combination of the number of speakers other than the sub woofer SW and the presence/absence of the sub woofer SW so as to indicate the number of speakers corresponding to each pattern. In this case, for example, there is a method whereby the pattern number is expressed by three digits, the first digit among the characters of three digits indicates the number of speakers other than the sub woofer SW, the second digit is expressed by a delimiter symbol such as "- (hyphen)" or the like, and the third digit showing the presence or absence of the sub woofer SW is expressed by "1" or "0". That is, as shown at the lowest stages in FIGS. 2 and 3, for example, in the case where "the front speakers FL and FR exist, the center speaker C exists, the surround speakers SL and SR exist, and the sub woofer SW does not exist", the pattern number is expressed as "5-0". It is assumed hereinbelow that such an indication of three digits is used as a pattern number.

As mentioned above, in the AV acoustic apparatus 100, those pattern numbers and various parameters and the like in the AV acoustic apparatus 100 to perform the speaker setup corresponding to the pattern number are stored in the memory provided in the apparatus 100 in association with each other. By designating the pattern number, the various parameters corresponding to the pattern number and the like are read out from the memory and each unit of the AV acoustic apparatus 100 is properly set.

Naturally, when considering also the information of layout positions (side/middle/behind, upper/lower, etc.) of the speakers, the number of patterns which can be constructed further increases. Examples of the patterns in the case of the 7.1ch system are shown in FIGS. 4 to 7 as references. As shown in FIGS. 4 to 7, 196 patterns can be constructed. FIG. 4 shows the example in which the large speaker is selected as a center speaker C. FIG. 5 shows the example in which the small speaker is selected as a center speaker C. FIG. 6 shows the example in which the center speaker C does not exist. FIG. 7 shows the example in which the small speakers are selected as front speakers FL and FR. In those examples, the layout positions of the surround speakers SL and SR can be selected from "side/middle/behind" and the layout positions of the surround back speakers SBL and SBR are fixed to "behind".

Figures 8, 9:
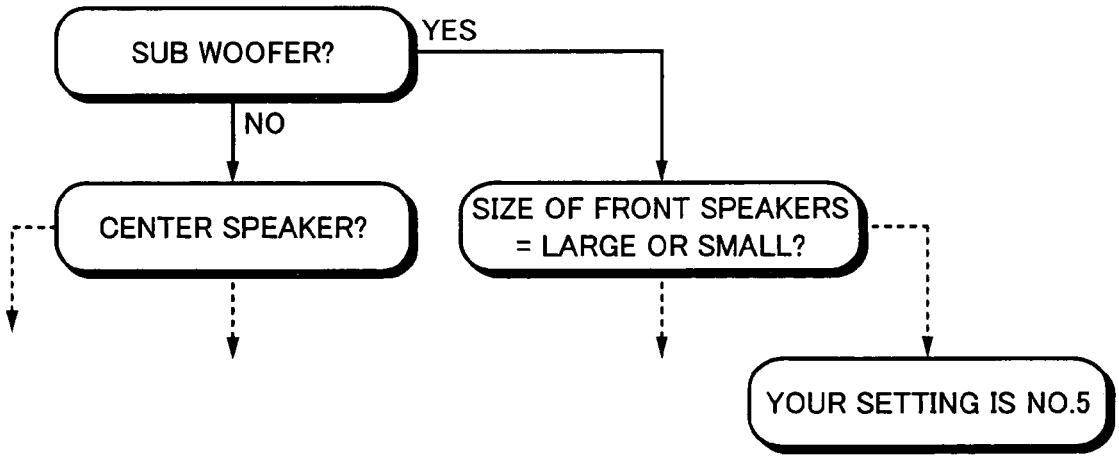
FIG. 8 is a schematic diagram showing an outline of a table of representative setting patterns of speakers.
FIG. 9 is a schematic diagram showing an outline of such a chart that the user can reach a pattern number by sequentially answering to questions.

A method of allowing the user to select a proper one of such a number of patterns will be schematically explained. As a first method, as shown in FIG. 8, for example, there is a method whereby a table showing typical speaker constructions by patterns is disclosed in an instruction manual or the like of the AV acoustic apparatus 100. The speaker constructions comprising the presence/absence, size, and the like of each speaker and the pattern number allocated to each speaker construction are described in the table. The user can recognize the pattern number corresponding to his own system by referring to the table.

As a second method, as shown in FIG. 9, for example, there is a method whereby a chart in which the user can reach the pattern number by sequentially answering questions is disclosed in the instruction manual or the like of the AV acoustic apparatus 100. The user can recognize the pattern number corresponding to his own speaker construction by sequentially answering the questions shown in the chart on the basis of his own speaker construction.

Figure 10A:
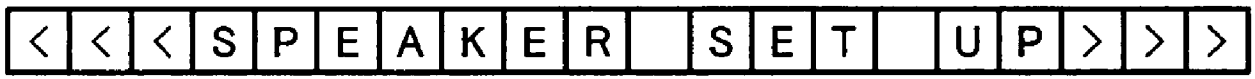
FIGS. 10A to 10C are schematic diagrams showing an example of display when a speaker setup is performed.
Figure 10B:
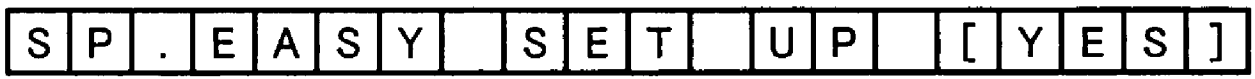
Figure 10C:
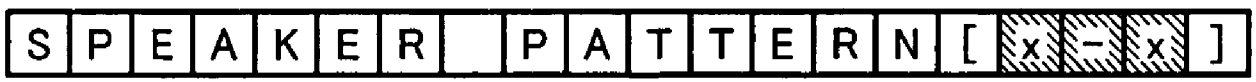

The pattern number obtained as mentioned above is inputted to the AV acoustic apparatus 100 by the user and the speaker setup to the AV acoustic apparatus 100 is performed. For example, the user properly operates the setting operation unit 112 and allows a speaker setup menu to be displayed on the display unit 111 as shown in an example of FIG. 10A. When the mode to perform the speaker setup by the operation of the setting operation unit 112 is selected, subsequently, a question showing whether an easy setup is executed or not is displayed on the display unit 111 as shown in an example of FIG. 10B. When the setting operation unit 112 is operated on the basis of this display and a mode to perform the easy setup is selected, a message for urging the user to enter the pattern number obtained by the method shown in FIG. 8 or 9 mentioned above is displayed on the display unit 111 as shown in an example of FIG. 10C. In the example of FIG. 10C, the position where the pattern number is displayed is emphasized by a flickering indication. For example, since the pattern numbers are displayed in ascending order into the pattern number display portion by executing a predetermined operation to the setting operation unit 112, the user selects the pattern number corresponding to his own system and determines the selection. When the selection is decided, the various parameters corresponding to the decided pattern number and the like are read out from the memory and a predetermined speaker setup is performed in the AV acoustic apparatus 100.

Figure 11:
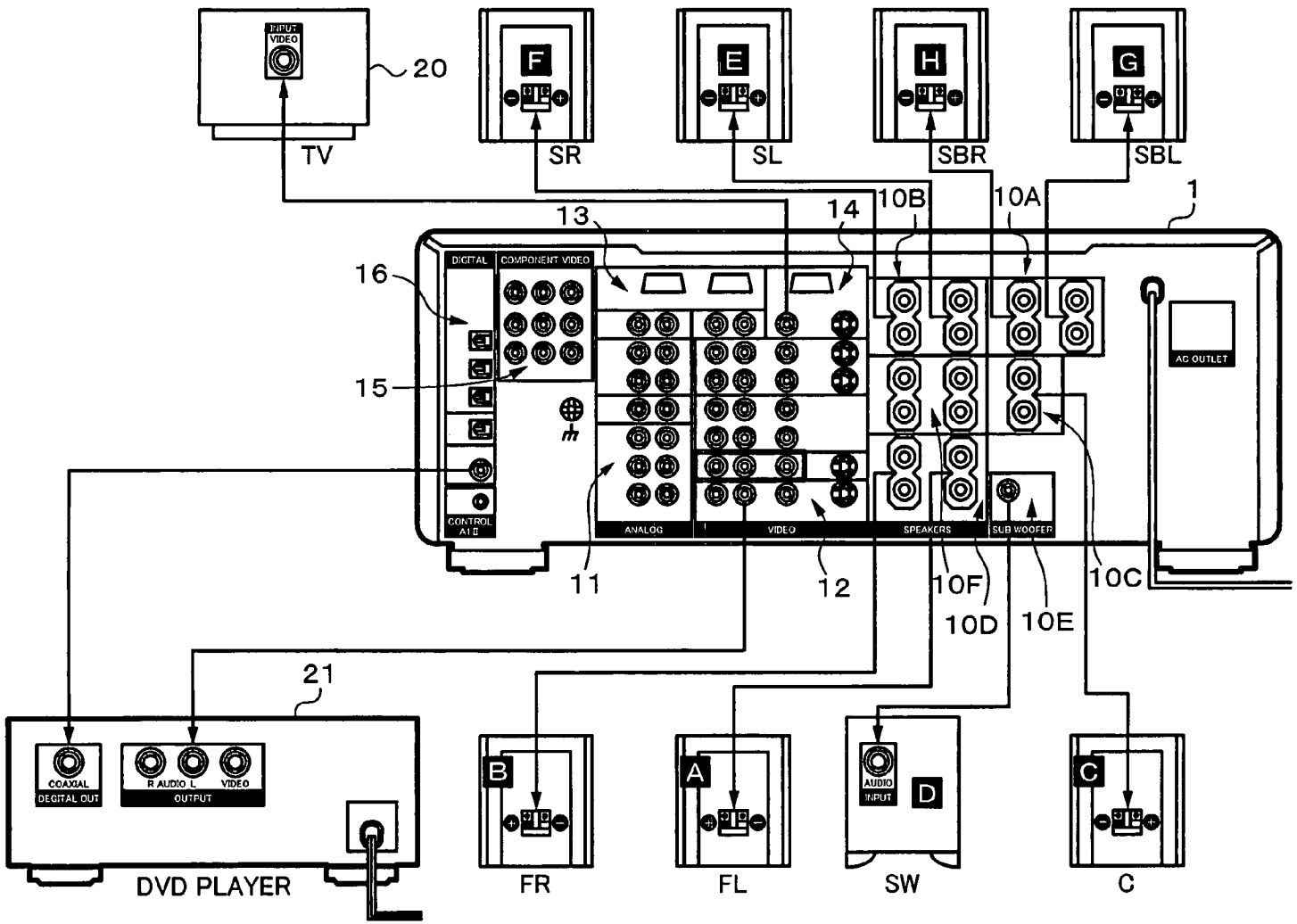
FIG. 11 is a schematic diagram showing a rear panel of an example of the AV acoustic apparatus which can be applied to an embodiment of the invention.

Subsequently, the speaker setup according to the embodiment of the invention will be more specifically explained. FIG. 11 shows a rear panel of an example of an AV acoustic apparatus 1 which can be applied to the embodiment of the invention. As shown in the diagram, a number of terminals are arranged on the rear panel of the AV acoustic apparatus 1. That is, a plurality of input terminals for inputting digital and analog audio signals, a plurality of speaker terminals for multichannel reproduction, terminals for input/output of a video signal, a control signal, and the like, etc. are arranged.

More specifically speaking, the AV acoustic apparatus 1 corresponds to the 7.1ch surround system and the following speaker terminal portions are arranged. That is, a speaker terminal portion 10A where terminals of the surround back speakers SBL and SBR are provided, a speaker terminal portion 10B where terminals of the surround speakers SL and SR are provided, a speaker terminal portion 10C where terminals of the center speaker C are provided, a speaker terminal portion 10D where terminals of the front speakers FL and FR are provided, and a speaker terminal portion 10E where a terminal of the sub woofer SW is provided are arranged. A speaker terminal portion 10F is provided for connecting other front speakers FL and FR.

The user properly selects ones of the speaker terminal portions 10A to 10E and 10F in accordance with a situation of a listening room, a sound field environment which the user wants to realize, or the like and connects the desired speakers.

With respect to the analog audio signal, input terminals and output terminals for recording are provided for an analog audio input/output terminal portion 11. In the case of the analog audio signal, input terminals are independently provided for each channel of the surround system. With respect to the analog AV signal, input terminals and output terminals are provided for an analog video input terminal portion 12.

Input terminals of the digital video signal are provided for a digital video input terminal portion 13.

Terminals for outputting the video signal to, for example, a video monitor apparatus as a television receiver 20 are provided for a monitor output terminal portion 14. In the example of FIG. 11, video signal output terminals corresponding to a composite video signal, an S video signal, and the digital video signal are provided, respectively. The S video signal is an analog video signal obtained by separating a luminance signal and a chroma signal from the composite video signal. Input terminals and output terminals of component video signals are provided for a component video input/output terminal portion 15.

Input/output terminals of an optical digital audio signal which is transmitted through an optical cable, input terminals of the digital audio signal which is transmitted through a coaxial cable, and external control terminals for inputting and outputting a control signal from the outside are provided for a digital input/output terminal portion 16. In the case of the digital audio signal, the audio signals in the respective surround channels are multiplexed to one serial digital signal and supplied.

Figure 12:
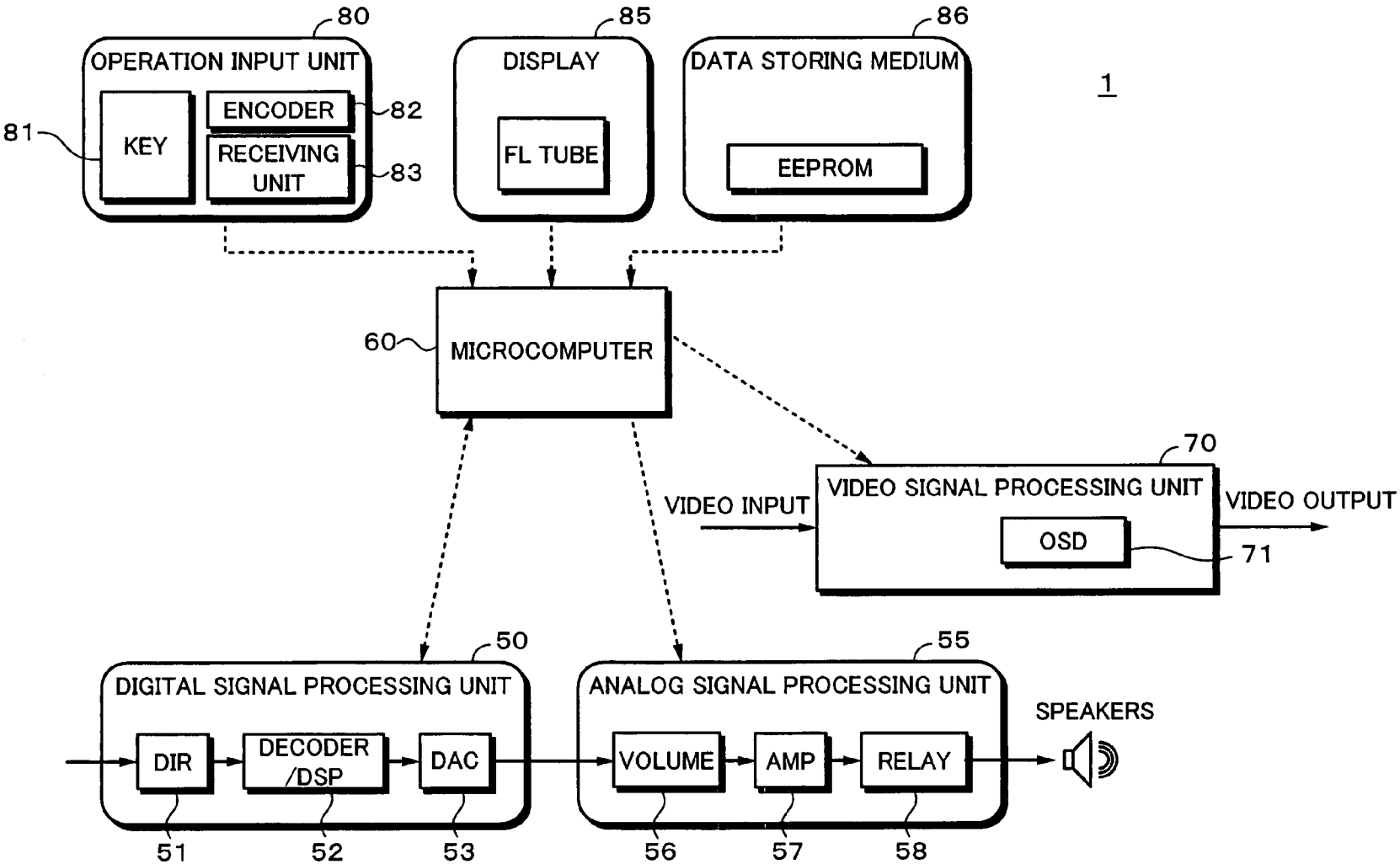
FIG. 12 is a block diagram showing a construction of an example of the AV acoustic apparatus which can be applied to the embodiment of the invention.

FIG. 12 shows a construction of the example of the AV acoustic apparatus 1. The AV acoustic apparatus 1 comprises schematically: a digital signal processing unit 50; an analog signal processing unit 55; an operation input unit 80; a display 85; and a data storing medium 86. The whole AV acoustic apparatus 1 is controlled by a microcomputer 60. Although not shown, the microcomputer 60 has a CPU (Central Processing Unit), a ROM (Read Only Memory), a RAM (Random Access Memory), and the like and controls the AV acoustic apparatus 1 by using the RAM as a work memory on the basis of a program which has previously been stored in the ROM. The foregoing speaker setup table in which the pattern numbers, the various parameters in the AV acoustic apparatus 1 for performing the speaker setup corresponding to the pattern number, and the like are listed in association with each other is previously stored in, for example, this ROM.

As various operating means which is used for the user to operate the AV acoustic apparatus 1, various keys 81, various rotary encoders 82, a receiving unit 83 of an infrared signal which is transmitted from a remote control commander (not shown), and the like are provided in the operation input unit 80. The rotary encoders 82 comprises a volume knob for adjusting a sound volume and a data knob for inputting data. The various keys 81 and various rotary encoders 82 output control signals corresponding to the operation. The control signals are supplied to the microcomputer 60. The remote control commander is constructed in such a manner that the user can execute an operation which is almost similar to an operation which is executed by using the various keys 81 and rotary encoders 82. The remote control commander modulates the control signal corresponding to the operation into the infrared signal and transmits it. The infrared signal is received by the receiving unit 83. The reception signal is demodulated and supplied as a control signal to the microcomputer 60.

The display 85 is constructed by, for example, an FL tube (cold-cathode tube) or the like and displays in accordance with a display control signal supplied from the microcomputer 60. That is, the display control signal outputted from the microcomputer 60 is supplied to a driver circuit (not shown) and converted into a signal for driving the FL tube. A predetermined display is performed by the FL tube in response to the FL tube driving signal. Naturally, the display 85 is not limited to the FL tube but another display device such as an LCD (Liquid Crystal Display), an LED (Light Emitting Diode), or the like can be used.

The data storing medium 86 comprises, for example, a non-volatile rewritable storing medium such as an EEPROM (Electrically Erasable Read Only Memory). The reading/writing operation of data or the like is executed to the data storing medium 86 by a command from the microcomputer 60. For example, the table of the speaker setup and the various set values of the AV acoustic apparatus 1 are stored as backup data into the data storing medium 86.

The digital signal processing unit 50 comprises a DIR (Digital Interface Receiver) 51, a decoder/DSP (Digital Signal Processor) 52, and a DAC (Digital/Analog Converter) 53. The DIR 51 converts the optical digital audio signal inputted from the digital input/output terminal portion 16 into a digital audio signal as an electric signal. The digital audio signal outputted from the DIR 51 is supplied to the decoder/DSP 52.

The decoder/DSP 52 comprises: a decoder unit for executing a decoding process to the supplied digital audio signal; and a DSP unit for executing a signal process to the decoded digital audio signal.

In the decoder/DSP 52, if the supplied digital audio signal is the compression encoded signal, it is decoded into the digital audio signal of a base band by the decoder unit. If the decoded digital audio signal is the signal obtained by multiplexing the multichannel signals of a 5.1ch system or the like into the serial digital signal, it is separated into the digital audio signals in the respective channels.

In the DSP unit, predetermined signal processes are executed to the separated digital audio signals in a plurality of channels. For example, the speaker settings stored in the data storing medium 86 are read out to the microcomputer 60. On the basis of the setting information, the predetermined signal processes are executed to the digital audio signals in a plurality of channels. When the number of connected speakers is less than the number of channels, or the like, a down-mixing process for mixing the signals in the predetermined channels and reducing the number of channels is executed. On the contrary, when the number of connected speakers is larger than the number of channels, or the like, a process for falsely increasing the number of channels can be executed.

The digital audio signal outputted from the decoder/DSP 52 is supplied to the DAC 53, converted into the analog audio signal every channel, and supplied to the analog signal processing unit 55. The analog signal processing unit 55 has a volume unit 56, an amplifier 57, and a relay 58. The volume unit 56 adjusts the level of the supplied analog audio signal every channel on the basis of the control of the microcomputer 60 according to the operation of the volume encoder in the operation input unit 80. The analog audio signals whose levels have been adjusted by the volume unit 56 are amplified by the amplifier 57 so that the speakers can be driven and transmitted to the speaker terminal portions 10A to 10F through the relay 58. The relay 58 is used to shut off the speaker output by the control of the microcomputer 60. For example, the output to the speaker which is not used is shut off in accordance with the contents of the speaker setup.

Figure 13:
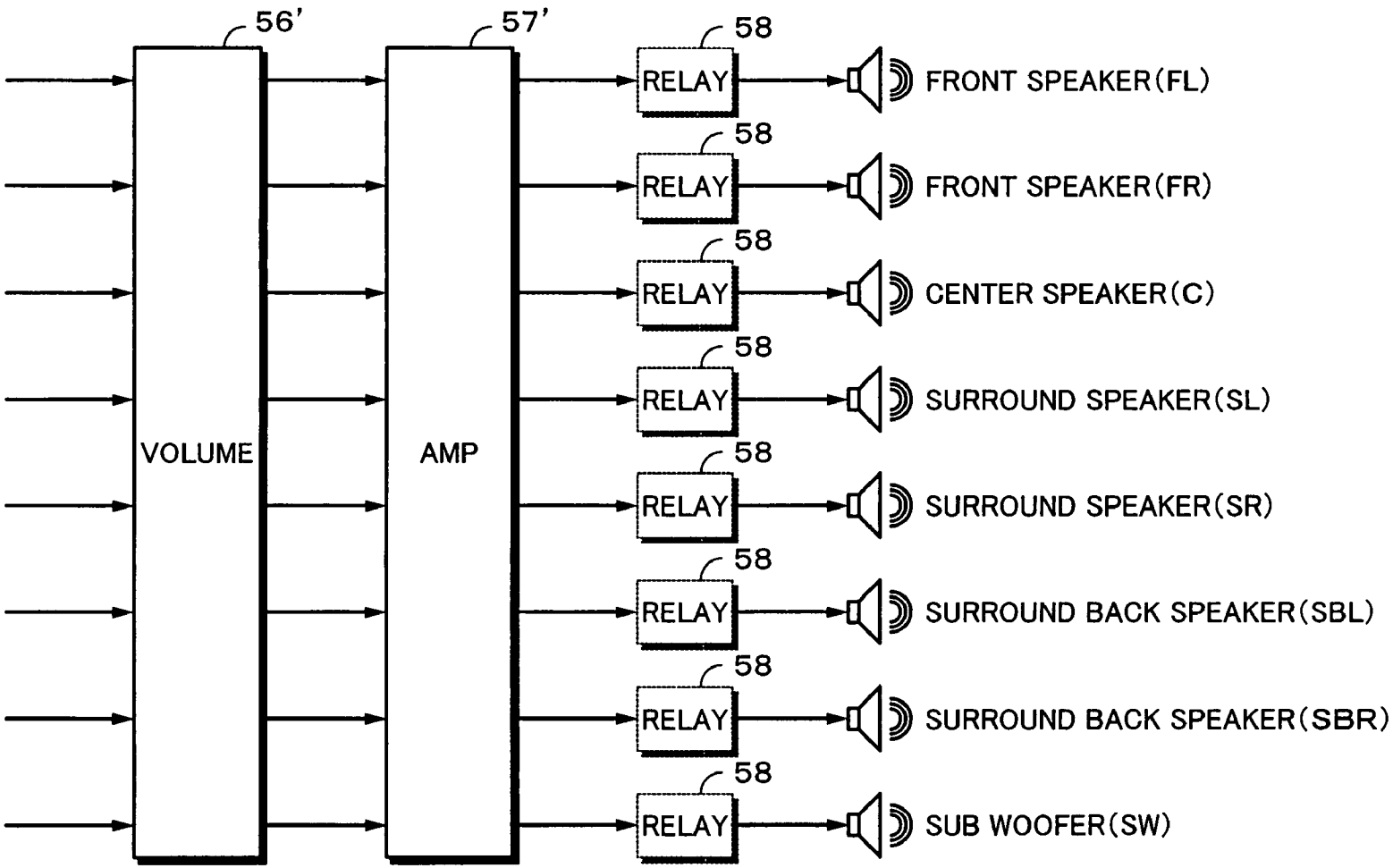
FIG. 13 is a block diagram showing a construction of an example of an output unit corresponding to multichannel.

Although a circuit of only one channel is shown in FIG. 12, actually, circuits of the number as many as the number of corresponding channels are provided as shown in an example in FIG. 13.

A video signal processing unit 70 executes predetermined signal processes to the video signals inputted from the digital video input terminal portion 13, the analog video input terminal portion 12, and the component video input/output terminal portion 15 and supplies the processed signals to the monitor output terminal portion 14. In this example, the analog video signal is converted into the digital video signal and digital-processed by the video signal processing unit 70. On the output side as well, the signal transferred to the analog video signal output terminal is D/A converted and outputted. Naturally, the video signal processes in the video signal processing unit 70 are not limited to those shown in the example.

The video signal processing unit 70 has an OSD unit 71 and can form a video signal for OSD (On Screen Display) (hereinafter, such a video signal is referred to as an OSD signal) in accordance with the command from the microcomputer 60. The OSD signal is transferred to the monitor output terminal portion 14 in a manner similar to other video signals. The OSD signal can be synthesized with the inputted video signal. The OSD signal can be also switched to the input video signal and outputted.

In such a construction, the user connects the predetermined speakers properly arranged in the listening room to the speaker output terminal portions 10A to 10F and performs a speaker setup, which will be explained hereinafter. For example, the user properly connects a digital audio signal output of a DVD (Digital Versatile Disc) player 21 to the digital input/output terminal portion 16, properly connects a video signal output to the analog video input terminal portion 12, and connects the monitor output terminal portion 14 to video input terminals of the monitor apparatus (the television receiver 20), so that he can enjoy a video image and audio sounds by a reproduction output of the DVD player 21.

A correspondence relation of an example between each construction shown in FIG. 12 and each means in claim 1 is shown hereinbelow. Output control means corresponds to the microcomputer 60. By the control of the microcomputer 60, a part or the whole of the analog signal processing unit 55 and a part or the whole of the digital signal processing unit 50 are controlled, and the output control of each channel is made. The table is stored into the data storing medium 86. Operating means corresponds to the operation input unit 80 and, particularly, corresponds to the setting input unit. The remote control commander (not shown) also corresponds to the operating means. Display means corresponds to the display 85. In claim 6, the display means further corresponds to the OSD unit 71. The above correspondence relation is shown as an example and not limited to it.

Figure 14:
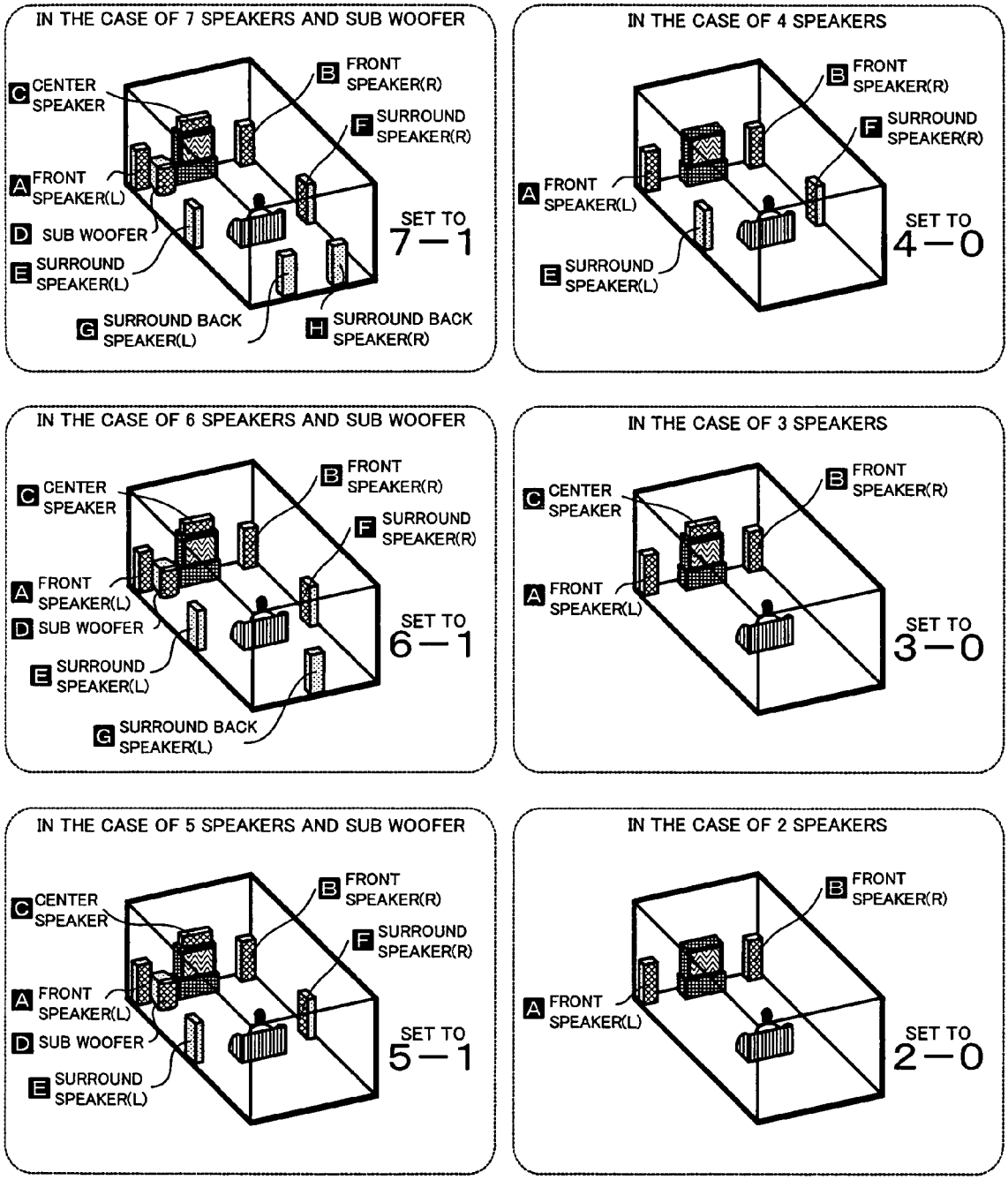
FIG. 14 is a schematic diagram of examples in each of which a layout of speakers in an actual listening room is shown by an illustration and each pattern is visually expressed.

The table of the speaker setting patterns in FIG. 8 mentioned above and the flowchart of FIG. 9 will now be more specifically explained. In FIG. 14, a layout of the speakers in the actual listening room is shown as a picture and each pattern is visually expressed. FIG. 14 corresponds to the table of the speaker setting patterns in FIG. 8 as mentioned above. The user selects the pattern which is closer to his own environment by watching this picture. Since the corresponding pattern numbers ("7-1", "4-0", "6-1", etc.) are written in the pictures, the user can easily recognize the pattern number matched with his own environment. In this case, there is such an advantage that the display by the pictures is common in all nations and can be understood.

Figure 15:
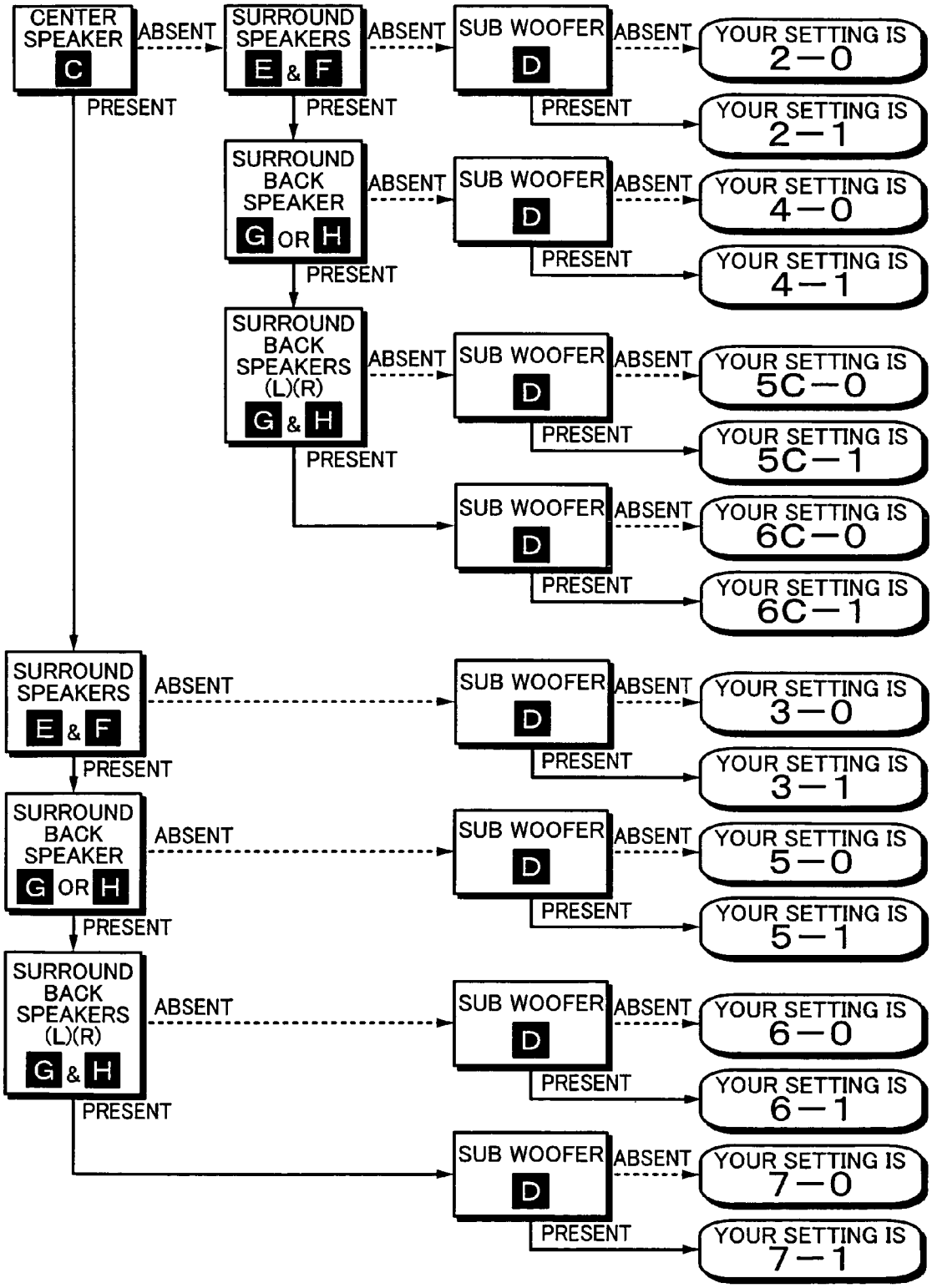
FIG. 15 is a schematic diagram showing more specifically a chart of an example for selecting the pattern number.

FIG. 15 more schematically shows the chart of the example for selecting the pattern number. FIG. 15 corresponds to FIG. 9 mentioned above. In a manner similar to the chart of FIG. 9 mentioned above, the chart of FIG. 15 is constructed in such a manner that the user can recognize the pattern number last by sequentially answering the questions about the presence or absence of the connected speakers along the chart. For example, in the case where "the center speaker C exists, the surround speakers SL and SR do not exist, and the sub woofer SW exists", the pattern number "3-1" is obtained.

In the example of FIG. 15, first, the user answers the question about the presence or absence of the center speaker C, subsequently, answers the question about the presence or absence of the surround speakers SL and SR and the surround back speakers SBL and SBR, and answers the question about the presence or absence of the sub woofer SW last. Naturally, the order in the chart is not limited to such an example but, for example, the user can also answer the presence or absence of the sub woofer SW first.

Symbols "C", "D", "E", "F", "G", and "H" shown in the chart correspond to those shown in FIG. 11 mentioned above. That is, when FIG. 11 mentioned above and the chart of FIG. 15 are provided for the user, the user can discriminate the presence/absence by making the speakers connected to the AV acoustic apparatus 1 directly correspond to the speakers in the chart of FIG. 15.

Although the case where the pictures of FIG. 14 and the chart of FIG. 15 are provided as printed matter to the user has been described here, the invention is not limited to this example. That is, the selection based on the drawings of FIG. 14 and the selecting method based on the chart of FIG. 15 can be easily realized in a software manner. For example, it is possible to construct the apparatus in such a manner that a display unit for displaying statuses or the like of the AV acoustic apparatus 1 is provided on the front panel of the AV acoustic apparatus 1, a layout state of the speakers into a room is displayed on the display unit, and questions of the chart are sequentially displayed. Particularly, in the chart shown in FIG. 15, it is sufficient that at least the speaker names such as "C", "SL", "SR", "SBL", "SBR", and "SW" and the indication such as "YES/NO" showing the presence or absence of the speakers can be displayed. It is also sufficient to execute the operation which can input "YES" or "NO". Therefore, such a construction can be extremely easily realized. As an indication of FIG. 14 as well, if an icon indication or the like showing the speaker is used, effective expression can be made in a limited area.

The speaker setting method according to the embodiment of the invention will now be more specifically explained. Prior to performing the speaker setup, the keys 81 and the encoders 82 in the operation input unit 80 are properly operated by the user and a message for instructing the user to perform the speaker setup is displayed to the AV acoustic apparatus 1. A message for urging the user to select whether the speaker setup is performed by the easy setup or not is displayed onto the display 85 in accordance with such an instruction.

Figure 16A:
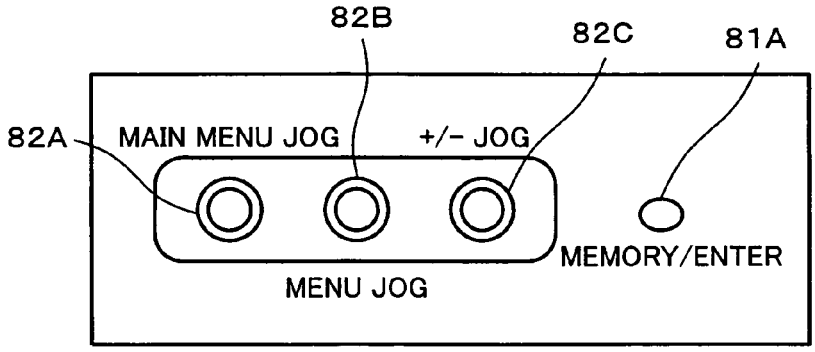
FIGS. 16A to 16C are schematic diagrams each showing an example of a construction of a setting input unit for performing various setups such as speaker setup and the like to the AV acoustic apparatus.
Figure 16B:
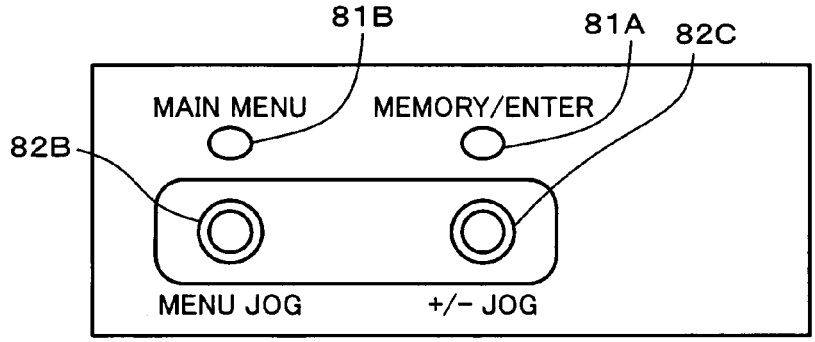
Figure 16C:
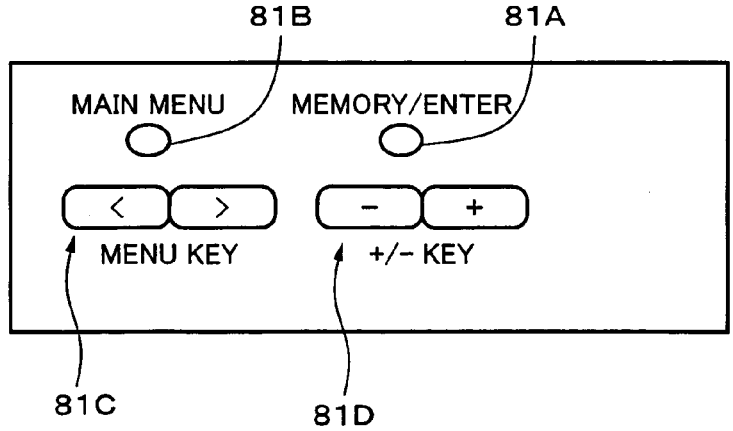

FIGS. 16A to 16C show examples of a construction of the setting input unit, in the operation input unit 80, for performing various setups such as speaker setup and the like to the AV acoustic apparatus 1. FIG. 16A shows the example in which three rotary encoders 82A, 82B, and 82C are used. In this example, the rotary encoder 82A is used for selection of a main menu, the rotary encoder 82B is used for selection of items in the menu, and the rotary encoder 82C is used for selection of a value in each item, respectively. A key 81A is an enter key. By operating the key 81A, the values set by using the rotary encoders 82A, 82B, and 82C can be determined. After the determination, processes such as display of the next selecting display screen, storage of the set values into the data storing medium 86, and the like are properly executed in accordance with the present operation contents.

FIG. 16B shows the example in which the two rotary encoders 82B and 82C and two keys 81A and 81B are used. The key 81B corresponds to the rotary encoder 82A in FIG. 16A. The main menu is switched each time the key 81B is operated. The key 81A arranged on the right side of the upper stage is the enter key. The rotary encoder 82B is used for selection of items in the menu. The rotary encoder 82C is used for selection of the value in each item.

FIG. 16C shows the example in which the rotary encoders 82 are not used but all elements are constructed by the keys 81. The main menu call key 81B and the enter key 81A are arranged at the upper stage. Two keys 81C as one pair which are arranged on the left side at the lower stage correspond to the rotary encoder 82B in FIG. 16A and are the keys for selection of the items in the menu. The items are advanced one by one by a ">" key. The items are returned one by one by a "<" key. Two keys 81D as one pair which are arranged on the right side at the lower stage correspond to the rotary encoder 82C in FIG. 16A and are the keys for selection of the values. The values are advanced one by one by a "+" key. The values are returned one by one by a "−" key.

Figure 17A:
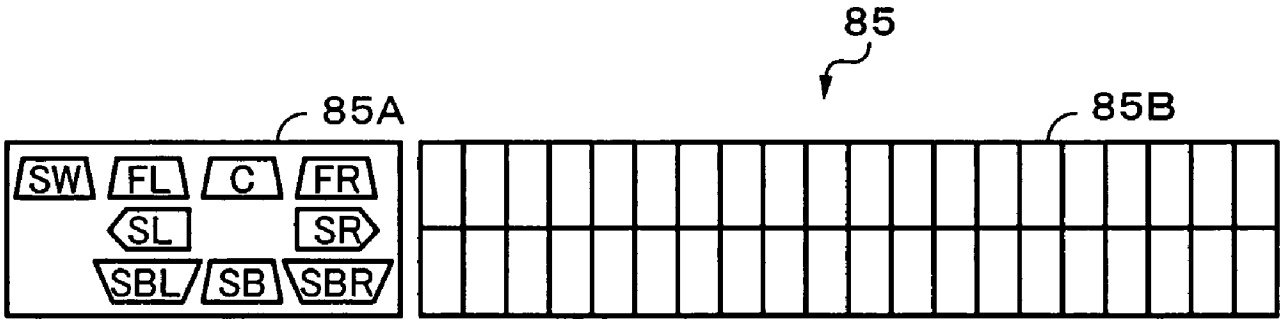
FIGS. 17A to 17C are schematic diagrams each showing an example of a construction of a display.
Figure 17B:
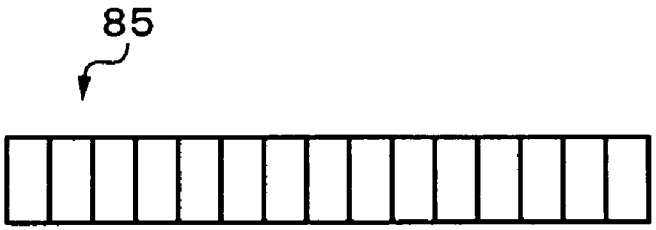
Figure 17C:
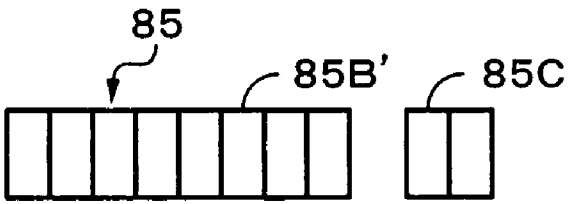

FIGS. 17A to 17C show examples of a construction of the display 85. FIG. 17A shows the example in which the display 85 is constructed by a display unit 85A for displaying the speaker layout and a display unit 85B which can display characters by two lines each showing 20 characters. FIG. 17B shows the example of the display 85 which can display 15 characters. FIG. 17C shows the example of the display 85 which can display 8 characters. In the example of FIG. 17C, the display 85 is constructed by a display unit 85B' which can display 8 characters and a display unit 85C which can display 2 characters. The display unit 85C executes, for example, an auxiliary display for the display of the display unit 85B'. In the display 85, the display unit 85A for displaying the speaker layout can be combined with the constructions of FIGS. 17B and 17C.

Figure 18:
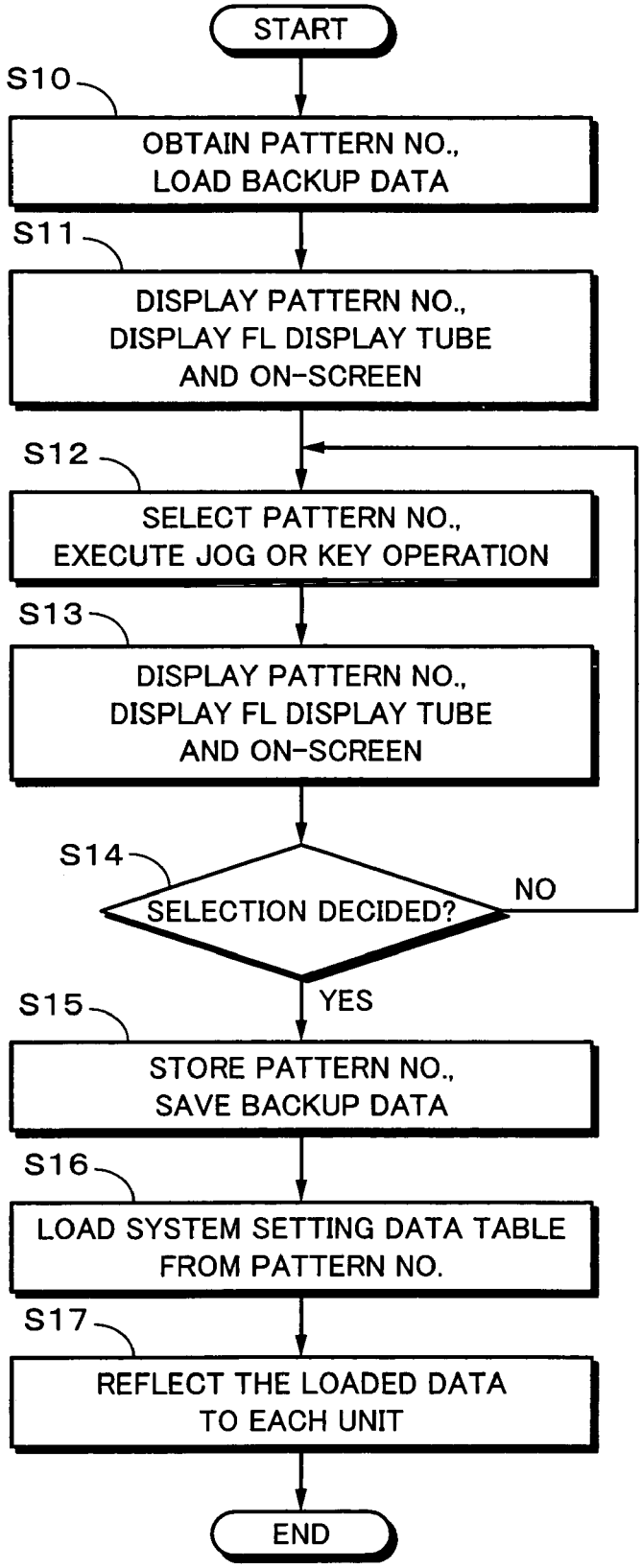
FIG. 18 is a flowchart showing processes of an example in the case of performing the speaker setup to the AV acoustic apparatus on the basis of the pattern number.

FIG. 18 is a flowchart showing processes of an example in the case of performing the speaker setup to the AV acoustic apparatus 1 on the basis of the pattern number obtained by using the pictures in FIG. 14 or the chart of FIG. 15. In the following description, it is assumed that the construction of the setting input unit is based on FIG. 16A mentioned above and the display 85 has the construction of FIG. 17A mentioned above, unless otherwise specified. Prior to the processes of this flowchart, the rotary encoder 82A in the setting input unit is operated by the user and the speaker setup menu is selected from the main menu. The rotary encoder 82B is operated and a message for urging the user to select whether the speaker setup is easily performed or not is displayed.

A mode in which the speaker setup is easily performed is called an easy setup hereinbelow. Although details will be explained hereinafter, in the easy setup, the setup to a plurality of speakers connected to the AV acoustic apparatus 1 can be performed in a lump. A mode in which the setup to a plurality of connected speakers is individually performed to each of plurality of speakers is called a normal setup.

Figure 19A:
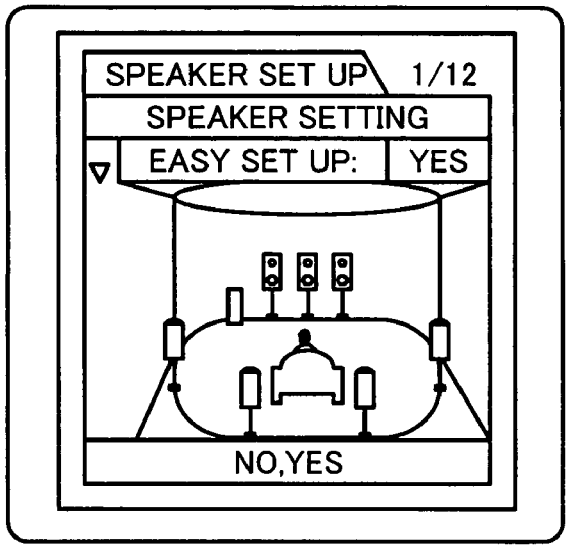
FIGS. 19A to 19C are schematic diagrams showing a display example in the case of selecting whether an easy setup is performed or not.
Figure 19B:
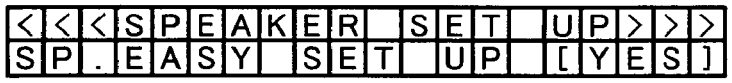
Figure 19C:
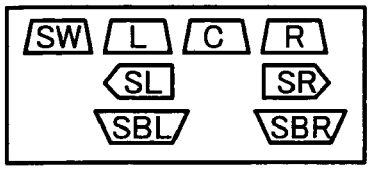

FIGS. 19A to 19C show a display example in the case of selecting whether the easy setup is performed or not. A message for urging the user to enter whether the easy setup is performed or not is displayed to the display unit 85B of the AV acoustic apparatus 1 as shown in an example in FIG. 19B. For example, by operating the rotary encoder 82C, "YES" or "NO" is alternately displayed in parentheses [ ]. When operating the rotary encoder 82C so as to display "YES", the easy setup is selected. When the display screen of FIG. 19B is displayed, the display unit 85A displays as shown in an example in FIG. 19C. The OSD display as shown in an example in FIG. 19A is displayed to the monitor apparatus. Although an indication of a default is performed in the display unit 85A and the OSD in the examples of FIGS. 19A to 19C, the invention is not limited to such examples but the present setup can be also displayed.

Figure 20:
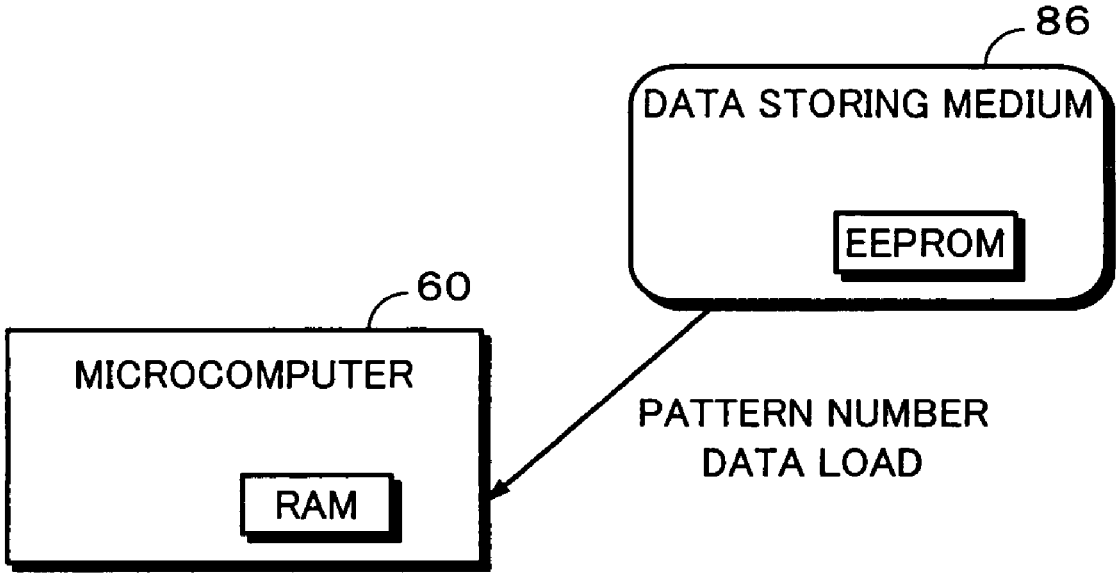
FIG. 20 is a diagram for explaining that backup data loaded from a data storing medium is stored into a RAM.

When the easy setup is selected by operating the rotary encoder 82B, first in step S10, backup data is loaded from the data storing medium 86 by the microcomputer 60 and temporarily stored into the RAM provided in the microcomputer 60 as shown in FIG. 20. The pattern number of the speaker setup is obtained from the backup data stored in the RAM. That is, the obtained pattern number corresponds to the speaker setup set at present to the AV acoustic apparatus 1. The invention is not limited to such an example but, for instance, it is also possible to always store a default speaker setup into the data storing medium 86 and load it.

In next step S11, the obtained pattern number is displayed to the display unit 85B of the display 85. As shown in an example in FIG. 21B, for example, the pattern number is displayed in parentheses [ ] at the lower stage of the display unit 85B by an indication (x-x) of three digits. In the example of FIG. 21B, the first digit in the indication of three digits in the parentheses [ ] indicates the number of speakers which are connected and the third digit shows the presence or absence of the sub woofer SW. As shown in an example in FIG. 21C, a display for visually showing the speaker layout corresponding to the pattern number is performed to the display unit 85A. As shown in an example in FIG. 21A, an OSD display for visually showing the speaker layout corresponding to the pattern number is performed. In the OSD display, the speaker layout is three-dimensionally expressed and the user can more intuitively grasp the speaker layout corresponding to the pattern number.

In the OSD display, for example, an instruction is issued from the microcomputer 60 to the OSD unit 71 in the video signal processing unit 70 so as to form an OSD signal for performing such an OSD display that the speaker layout corresponding to the pattern number is visually shown. On the basis of this instruction, the formed OSD signal is transferred to the monitor output terminal portion 14. Thus, the predetermined OSD display is performed to the monitor apparatus.

Figure 21A:
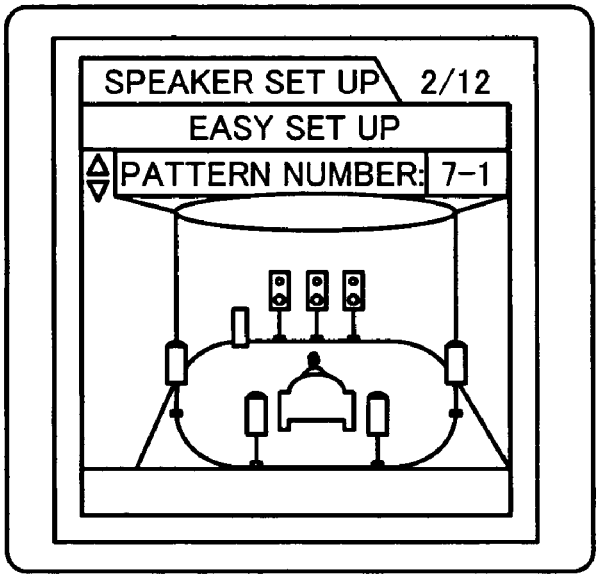
FIGS. 21A to 21C are schematic diagrams showing a display of an example of the pattern number and the speaker setup corresponding to the pattern number.
Figure 21B:
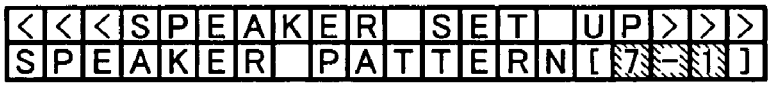
Figure 21C:
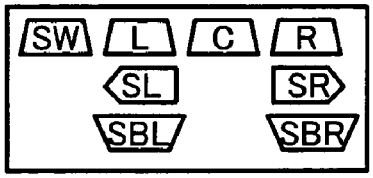
Figure 22A:
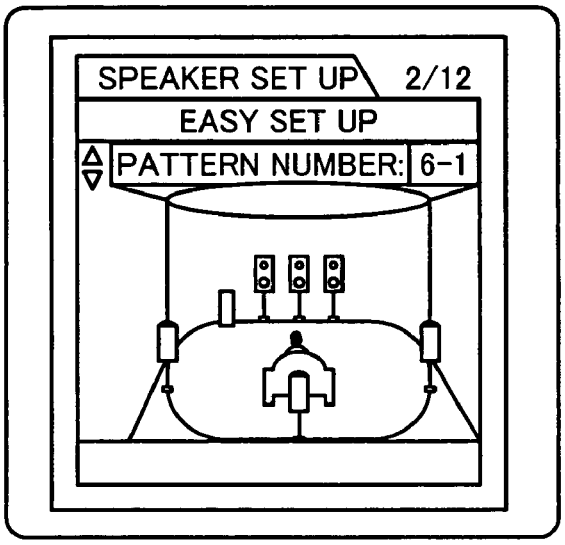
FIGS. 22A to 22C are schematic diagrams showing a display of an example of the pattern number and the speaker setup corresponding to the pattern number.
Figure 22B:
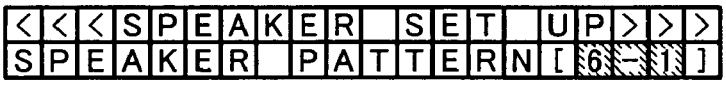
Figure 22C:
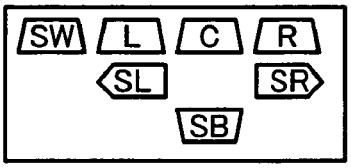
Figure 23A:
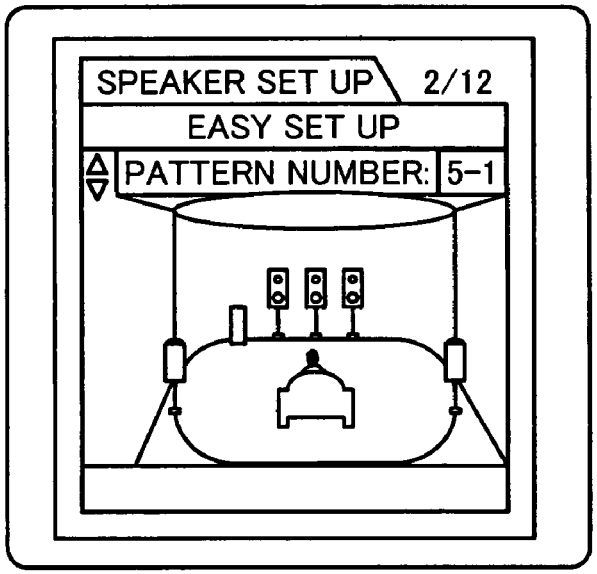
FIGS. 23A to 23C are schematic diagrams showing a display of an example of the pattern number and the speaker setup corresponding to the pattern number.
Figure 23B:
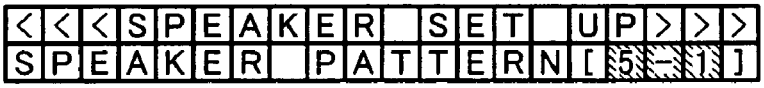
Figure 23C:
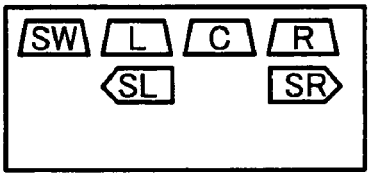
Figure 24A:
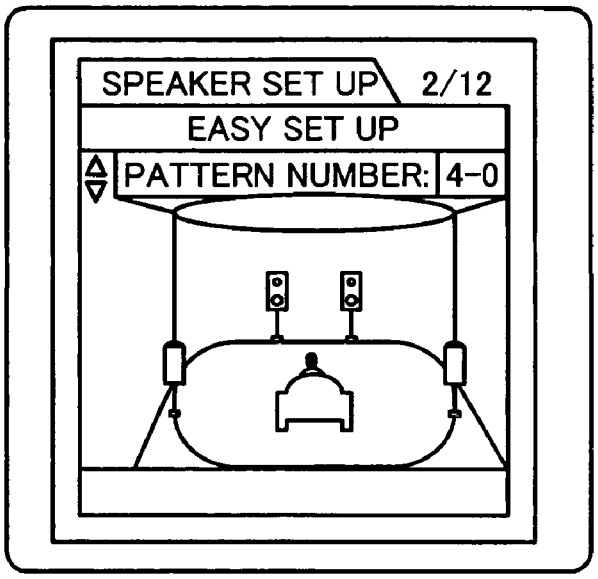
FIGS. 24A to 24C are schematic diagrams showing a display of an example of the pattern number and the speaker setup corresponding to the pattern number.
Figure 24B:
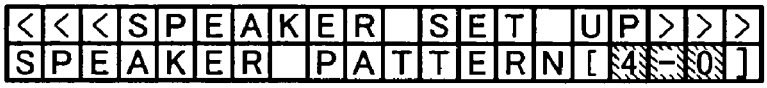
Figure 24C:
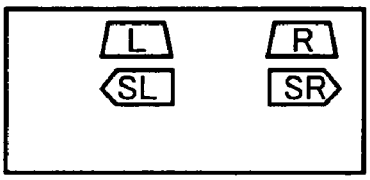
Figure 25A:
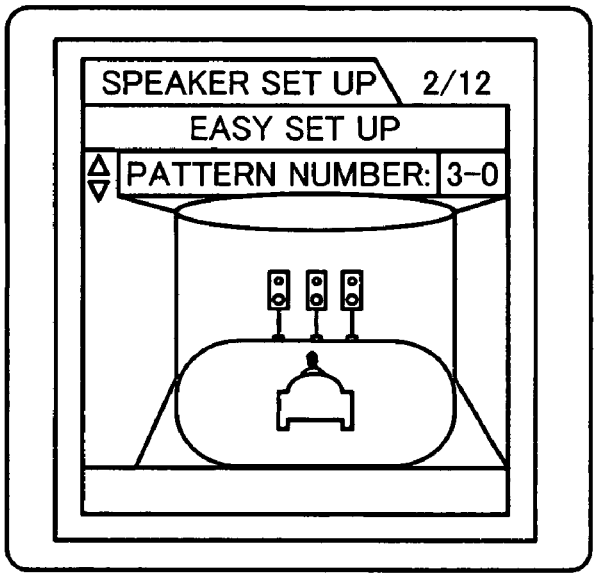
FIGS. 25A to 25C are schematic diagrams showing a display of an example of the pattern number and the speaker setup corresponding to the pattern number.
Figure 25B:
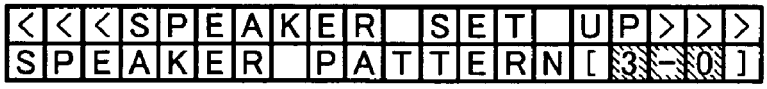
Figure 25C:
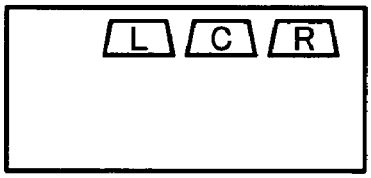
Figure 26A:
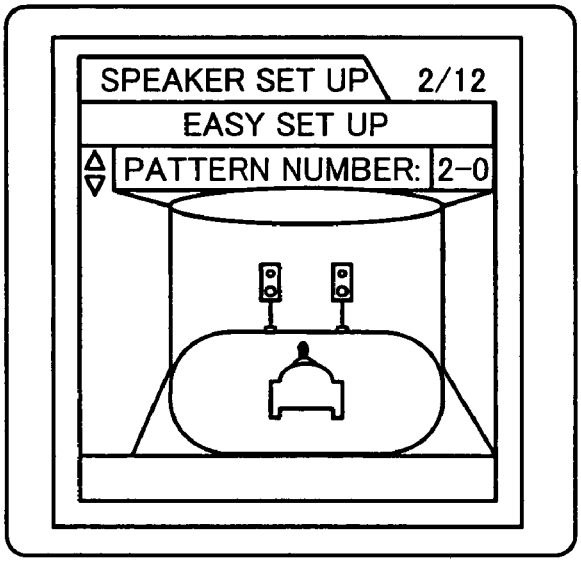
FIGS. 26A to 26C are schematic diagrams showing a display of an example of the pattern number and the speaker setup corresponding to the pattern number.
Figure 26B:
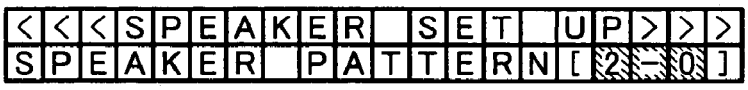
Figure 26C:
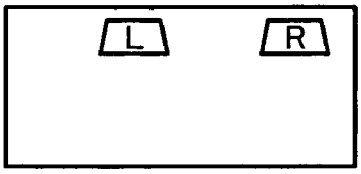

FIGS. 21A to 21C show the example in the case where the pattern number of the speaker setup is equal to [7-1]. In the pattern number [7-1], seven speakers in total comprising the speakers FL, FR, SL, SR, SBL, and SBR and the sub woofer SW are used.

On the basis of the display on the display 85 and the OSD display in the monitor apparatus, the setting operation unit is properly operated by the user and the pattern number is selected (step S12). For example, if the setting operation unit is constructed as shown in FIG. 16A or 16B, the next pattern number is selected by rotating the rotary encoder 82C by a predetermined angle (jog operation). If the setting operation unit is constructed as shown in FIG. 16C, the next pattern number is selected by operating the "+" key or the "−" key in the keys 81D once. In association with the selecting operation of the pattern number in step S12, the display 85 and the OSD display are changed (step S13). The pattern number is included in, for example, the backup data loaded in the process in step S10 mentioned above.

In step S14, whether the pattern number selected in step S12 has been determined or not is discriminated. For example, when the enter key 81A is operated, it is regarded that the selected pattern number has been determined. If the enter key 81A is not operated, the processing routine is returned to step S12 and the next pattern number is selected.

That is, by continuously rotating the rotary encoder 82C, the pattern numbers are successively selected. For example, as shown in examples of FIGS. 21A to 21C, 22A to 22C, and 26A to 26C, the pattern numbers are successively selected every rotation of the rotary encoder 82C of a predetermined angle. The display of the display 85 and the OSD display are successively changed in accordance with the selected pattern numbers. If the portion where the pattern numbers are displayed. (in the examples of FIGS. 21B to 26B, in the parentheses [ ] on the right end side at the lower stage) is emphasis displayed by flickering or the like on the display unit 85B during the selection, contents of the item which is being selected can be easily grasped. Therefore, such an emphasis display is preferable.

Figure 27:
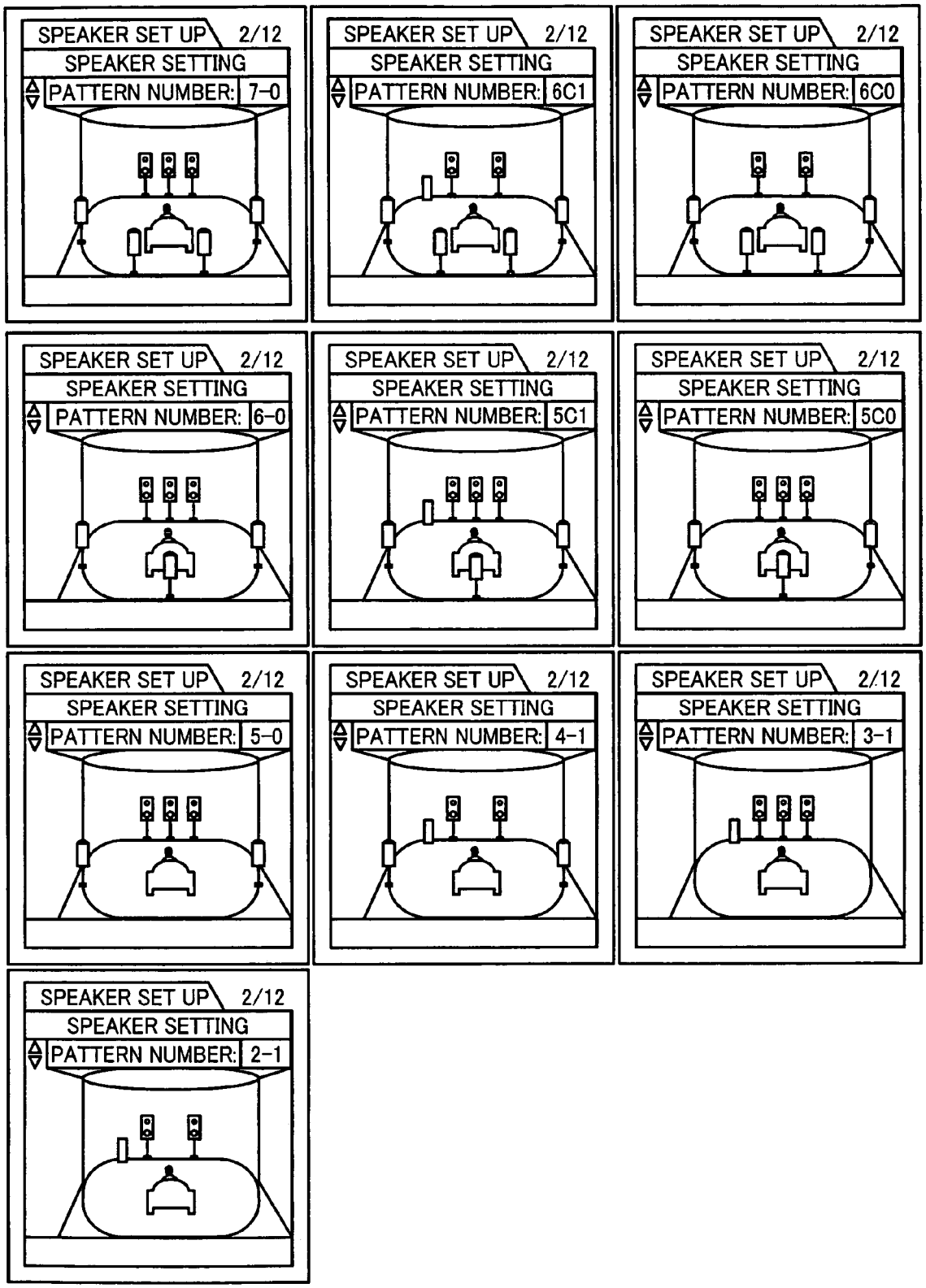
FIG. 27 is a schematic diagram showing an example of each pattern number and corresponding OSD display.

The display of the display 85 and the OSD display corresponding to each pattern number in FIGS. 21A to 26C are extraction and, actually, a larger number of pattern numbers and corresponding displays exist. FIG. 27 shows an example of each pattern number and corresponding OSD display (to avoid complexity, the display of the display 85 is omitted). Each time the rotary encoder 82C is rotated by the predetermined angle, the displays of FIGS. 21A to 26C and 27 and the like are sequentially displayed in predetermined order.

Figure 28:
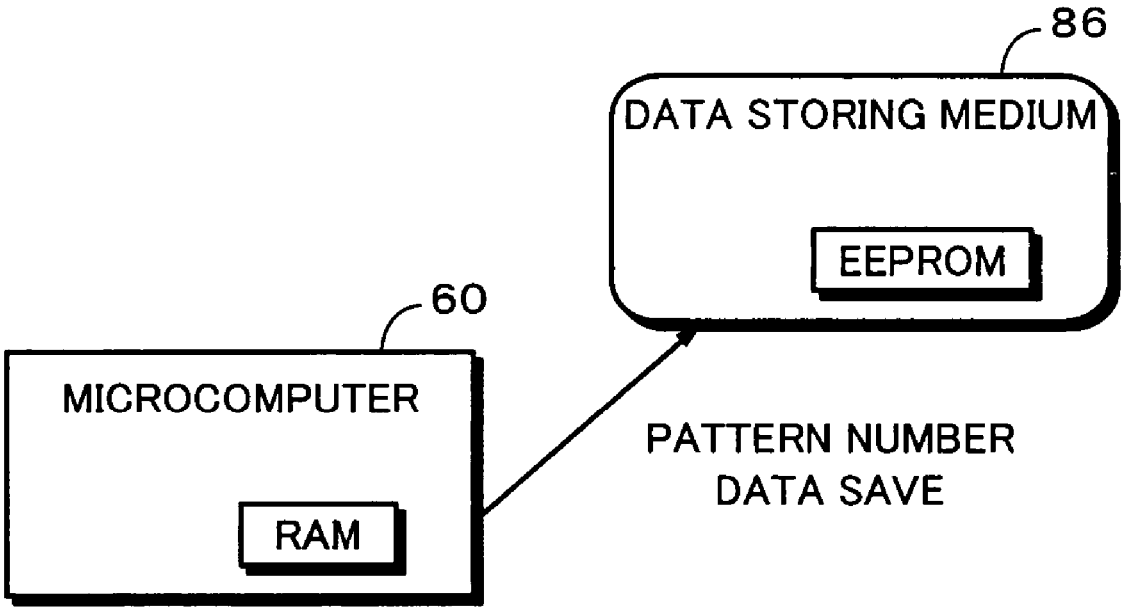
FIG. 28 is a diagram for explaining that backup data on which the pattern number has been overwritten is written back into the data storing medium.

Returning to the flowchart of FIG. 18, if it is determined in step S14 that the enter key 81A has been operated and the selected pattern number has been decided, the processing routine advances to step S15. The decided pattern number is held and the backup data is saved into the data storing medium 86. For example, the pattern number of the backup data stored in the RAM in the microcomputer 60 is overwritten by the decided pattern number. As shown in an example in FIG. 28, the backup data in which the pattern number has been overwritten is written back into the data storing medium 86. Even if the backup data is saved, the decided pattern number is held in the RAM in the microcomputer 60.

In next step S16, the data corresponding to the decided pattern number is read out and loaded from the speaker setup table which has previously been stored in the ROM in the microcomputer 60. FIG. 29 shows a correspondence example of the pattern number and a combination of the speakers. With respect to each of the front speakers FL and FR, the center speaker C, and the surround speakers SL and SR, large (L: LARGE)/small (S: SMALL) can be selected. Further, with respect to the center speaker C and the surround speakers SL and SR, whether they are used or not (Yes/No) can be selected. With respect to the surround back speakers, a setting in which two speakers are used (D: Dual), a setting in which one speaker is used (Sg: Single), and a setting in which those speakers are not used (NO) can be selected. With respect to the sub woofer SW, whether it is used or not (YES/NO) can be selected.

The pattern number is allocated to each of the foregoing combinations of the speakers which can be selected. In this example, the pattern number is expressed by three digits comprising a numeral, a symbol, and an English letter. One digit at the left edge indicates the number of speakers. One digit at the right edge indicates the presence or absence of the sub woofer SW. One digit at the center shows that when the value is equal to "C", if the center speaker C does not exist, the center speaker C is falsely constructed by using the front speakers FL and FR. The speaker layouts having the overlapped pattern number denote that although the combinations of the speakers are different, the same process is executed in the apparatus.

System setup data corresponding to the speaker combination with which the pattern number is associated is stored in the speaker setup table every pattern number. For example, the system setup data comprises: DSP parameters in the decoder/DSP 52 for executing the predetermined signal processes to the audio signal corresponding to each speaker output; down mix data which is used when the audio signals are mixed so as to reduce the number of channels of the audio signals; volume setting data for the volume unit 56; mute setting data; data for setting ON/OFF of the relay 58; and the like.

In next step S17, the data loaded in step S16 is reflected to each unit of the AV acoustic apparatus 1. That is, on the basis of the data loaded in step S16, a control process to each device in the digital signal processing unit 50 and the analog signal processing unit 55 is executed by the microcomputer 60.

For example, when the pattern number [3-0] is selected and determined, only the front speakers FL and FR and the center speaker C are used. Therefore, on a signal path of outputs of the speakers which are not used, the inserted relay 58 is set into a shut-off state and the input to the amplifier 57 is muted. The DSP parameters are set into the decoder/DSP 52 so as to down-mix the digital audio signals in the multichannel of the 5.1ch system into three channels comprising the right and left front channels and the center channel. A sound volume balance for each speaker output is set into the volume unit 56. If necessary, a delay, a phase, reverberation, and the like of each channel which is used can be also set into the decoder/DSP 52.

The setup which is performed by the microcomputer 60 in accordance with the pattern number is not limited to the foregoing items but can be made with respect to other items or it is not always necessary to perform the setup with respect to all of the foregoing items.

Although the case where the display 85 is constructed by the display unit 85A for displaying the speaker layout and the display unit 85B which can display characters by two lines each showing 20 characters has been described above, the speaker setup according to the easy setup can be performed by using a simpler display. For simplicity of explanation here, it is assumed that the setting operation unit has the foregoing construction of FIG. 16B comprising: the two rotary encoders 82B and 82C; and the two keys 81A and 81B.

Figure 30A:
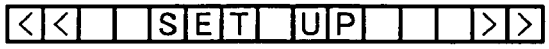
FIGS. 30A to 30D are diagrams for explaining the setting operation of an example using a display which can display 15 characters.
Figure 30B:
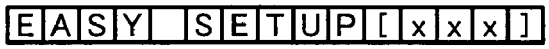
Figure 30C:
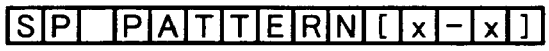
Figure 30D:
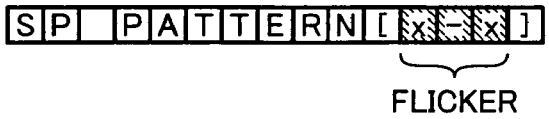

FIGS. 30A to 30D show a setup display of an example which is performed by the display 85 that can display 15 characters in FIG. 17B mentioned above. The setting operation in the example in this case will be schematically explained. First, the speaker setup menu is selected from the main menu by the key 81B (FIG. 30A). After that, the easy setup is selected by the operation of the rotary encoder 82B (FIG. 30B). The easy setup "YES" is selected by the rotary encoder 82C. The present set pattern number is displayed by the operation of the rotary encoder 82B (FIG. 30C). By operating the rotary encoder 82C in this state, the pattern numbers are sequentially selected and the pattern number display portion (hatched portion in the diagram) flickers as shown in FIG. 30D. When the desired pattern number is displayed, the enter key 81A is operated, thereby deciding the pattern number.

Figure 31A:
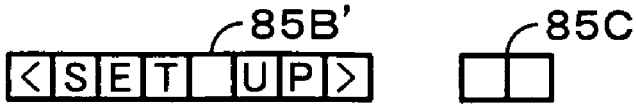
FIGS. 31A to 31E are diagrams for explaining the setting operation of an example using a display which can display 8 characters.
Figure 31B:
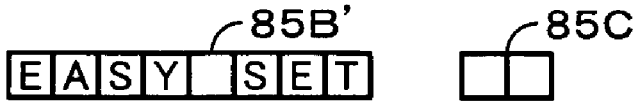
Figure 31C:
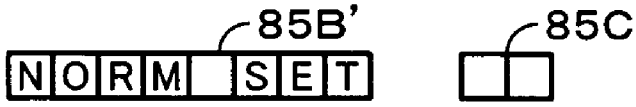
Figure 31D:
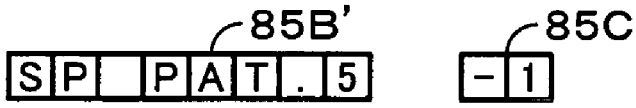
Figure 31E:
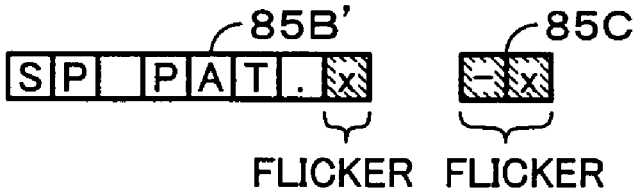

FIGS. 31A to 31E show a setup display of an example which is performed by the display 85 that can display 8 characters in FIG. 17C mentioned above. The setting operation in the example in this case will be schematically explained. First, the speaker setup menu is selected from the main menu by the key 81B (FIG. 31A). The easy setup is selected by the operation of the rotary encoder 82B (FIG. 31B). For example, the normal setup shown in FIG. 31C and the easy setup can be selected by operating the rotary encoder 82C. When the easy setup is selected and the rotary encoder 82B is operated, as shown in an example in FIG. 31D, the present set pattern number is displayed by the display units 85B' and 85C. By operating the rotary encoder 82C in this state, the pattern numbers are sequentially selected and the pattern number display portions (hatched portions in the diagram) flicker as shown in FIG. 31E. When the desired pattern number is displayed, the enter key 81A is operated, thereby deciding the pattern number.

The normal setup will now be schematically explained. As mentioned above, the normal setup is a setup mode in which the setup to a plurality of connected speakers is individually performed to each of the plurality of speakers. In the embodiment, in the normal setup, in consideration of the environment in actual use, predetermined limitations are provided for the patterns which can be set by the user. For example, the following limitations are provided.

1. In the case of the setup using the sub woofer SW, small speakers cannot be selected as front speakers FL and FR.
2. The size setting of the surround back speakers SBL and SBR is common to the setup of the surround speakers SL and SR.
3. In association with the above limitation in (2), the setup menu of the surround back speakers SBL and SBR is set to only the selection of "NONE", "1", and "2".

In accordance with the setup of one certain speaker, a pattern for forcedly determining the setup of the other speakers is provided, for example, in the following cases.

1. In the case of the setup in which the sub woofer SW is not used, the size of front speakers FL and FR is forcedly set to "LARGE". That is, in this case, the size setting of the front speakers FL and FR is fixed to "LARGE".
2. When the size setting of the front speakers FL and FR is set to "SMALL", the size setting of the center speaker C and the surround speakers SL and SR is forcedly set to "SMALL". That is, in this case, "LARGE" cannot be set as a size of the center speaker C and the surround speakers SL and SR.

3. In the case of the setup in which the surround speakers SL and SR are not used, the setup in which the surround back speakers SBL and SBR are not used is forcedly set.

Figure 32:
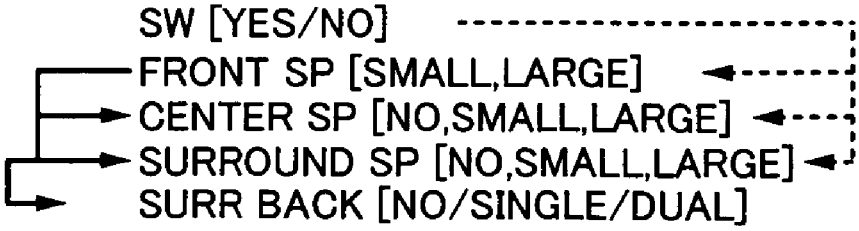
FIG. 32 is a diagram for explaining that when a setup of one speaker is changed, a setup of the other speakers is influenced by such a change.

The above limitations are summarized as shown in FIG. 32. In FIG. 32, an arrow indicates the speaker setup which exerts an influence by a change in setup. The setting about whether the sub woofer SW is used or not influences the size setting of the front speakers FL and FR, the setting about whether the center speaker C and the surround speakers SL and SR are used or not, and the size setting thereof. The size setting of the front speakers FL and FR influences the setting whether the center speaker C and the surround speakers SL and SR are used or not and the size setting thereof and also influences the setting of the number of surround back speakers SBL and SBR (including the setting about whether they are used or not).

FIGS. 33 to 35 show a list of the patterns of the speaker setup in the case where the apparatus can cope with up to the 7.1ch system. In the diagrams, "L" indicates the size "LARGE" of the speaker and "S" indicates the size "SMALL" of the speaker. "M" of the center speaker C denotes that the center speaker C is falsely constructed by using the front speakers FL and FR.

In FIGS. 33 to 35, a line on which a cancel line is written indicates the speaker setting patterns which cannot be set in consideration of the foregoing limitations or the like. In the examples, although 112 kinds of patterns which can be set exist in the state where each limitation is not considered, by considering the limitations or the like, the number of patterns which can be set is reduced to 68 kinds. Thus, since a capacity of the memory for storing the speaker setting patterns can be saved and a wasteful selection item is omitted, the user can more quickly perform the speaker setup.

A setting procedure of the normal setup will now be described. FIGS. 36A to 36E show a display of an example of the display 85 at the time of the normal setup. FIGS. 36A to 36E show only 20 digits at the lower stage of the display unit 85B in FIG. 17A mentioned above. In the normal setup, since whether the speaker is used or not and the size of the speaker are set every speaker, for example, the speakers to be set are switched by the rotary encoder 82B and whether the speaker is used or not and the size of the speaker are set by the rotary encoder 82C.

FIG. 36A shows the example of the setup of the sub woofer SW and whether the sub woofer is used or not can be set. FIG. 36B shows the example of the setup of the front speakers FL and FR and only the size can be set. FIGS. 36C and 36D show the examples of the setup of the center speaker C and the setup of the surround speakers SL and SR, and whether the speakers are used or not and the size of the speaker can be set, respectively. FIG. 36E shows the example of the setup of the surround back speakers SBL and SBR and the number of speakers including the case where they are not used can be set.

In each display, it is desirable to enable the user to recognize the setup forcedly switched by the setup of the other speakers by a method whereby, for example, the luminance of the character display is reduced (hereinafter, referred to as a "dark-out") or the like. In this case, the set values before they are forcedly made are buffered into the RAM or the like in the microcomputer 60 and, when the forced setup is cancelled, the stored set values are called.

Figure 37:
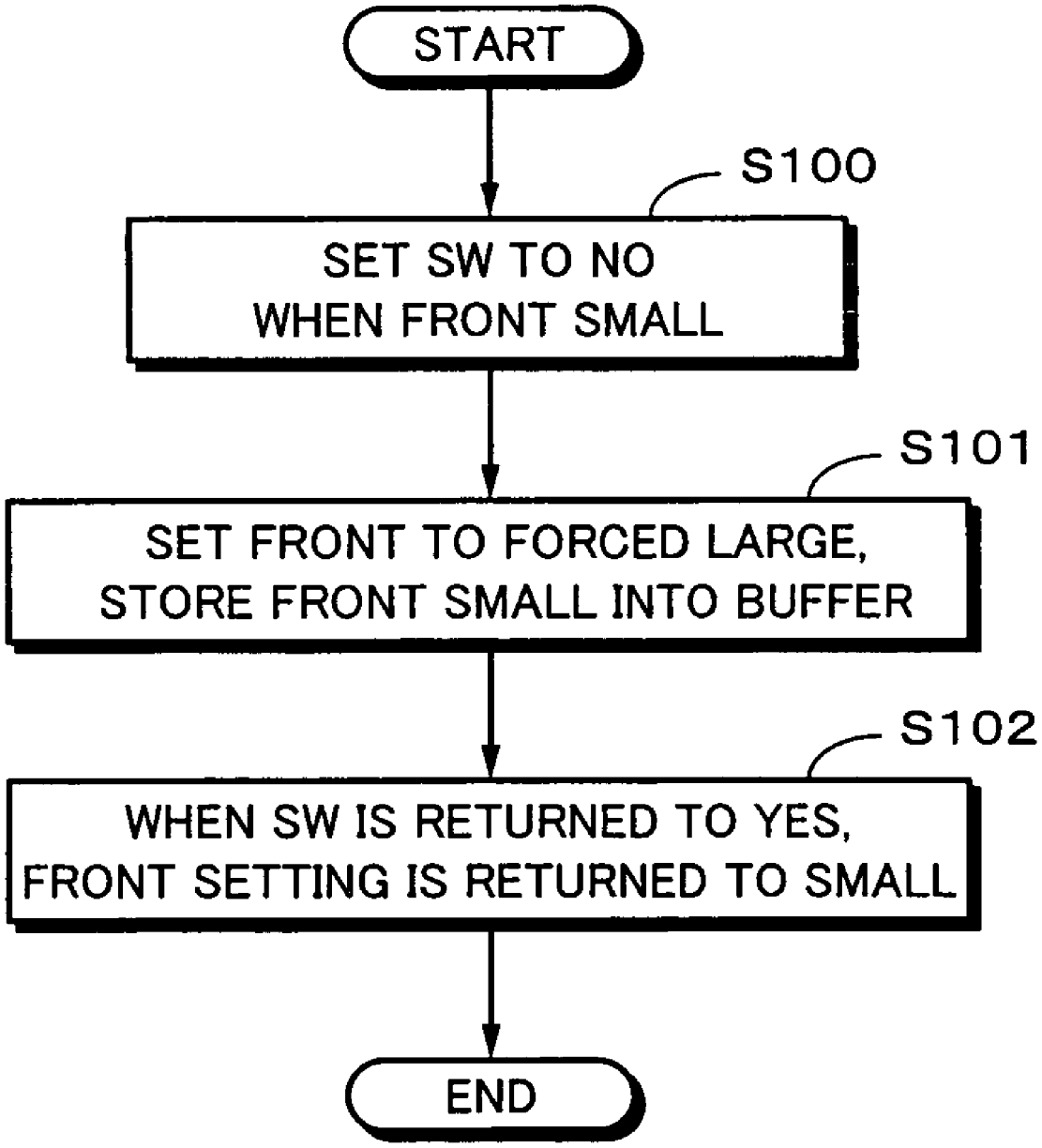
FIG. 37 is a flowchart showing processes of an example in which previous set values are called in the case where a forced setup is cancelled.

For example, as shown in an example in FIG. 37, it is assumed that in the state where the front speakers FL and FR are set to "small (SMALL)", the sub woofer SW is set to "is not used (NO)" (step S100). In this case, on the basis of the foregoing limitations, the front speakers FL and FR are forcedly set to "large (LARGE)". The setup "the front speakers FL and FR are (SMALL)" set by the user is buffered (step S101). After that, when the setup of the sub woofer SW is returned to "is used (YES)", the setup of the front speakers FL and FR is called from the buffer and returned to (SMALL) (step S102).

When the operation to change the set values is executed by the operation of the rotary encoder 82C or the like to the forcedly-set items which are dark-out displayed, the operation is regarded as a user operation, the dark-out display is cancelled, the display mode is returned to the normal display, and the buffered set values are cleared.

Figure 38:
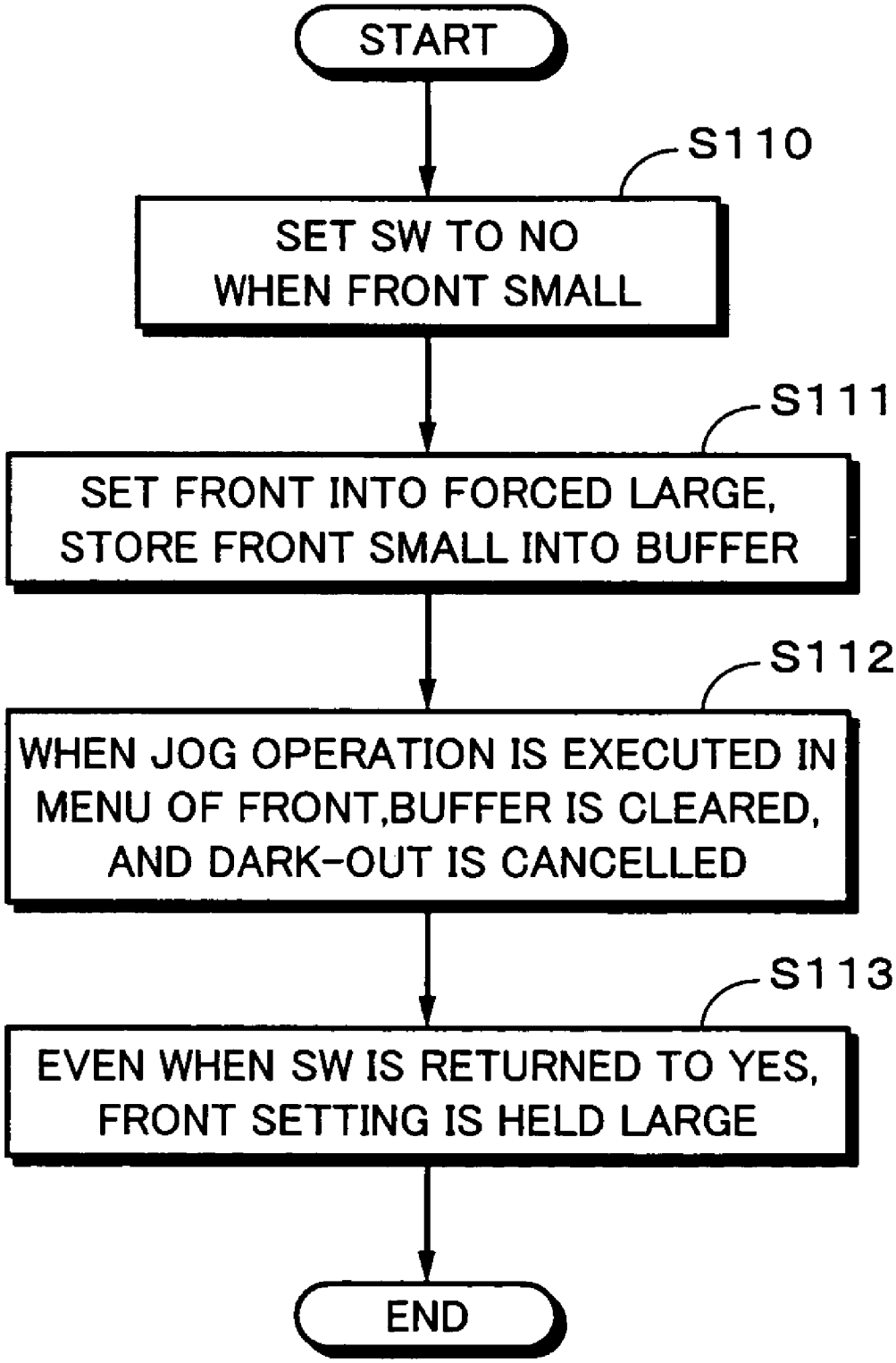
FIG. 38 is a flowchart showing processes of an example in case where the operation to change the set values is executed with respect to items which have forcedly been set.

For example, as shown in an example in FIG. 38, it is assumed that the sub woofer SW is set to "is not used (NO)" in the state where the front speakers FL and FR are set to (SMALL) (step S110). In this case, on the basis of the foregoing limitations, the front speakers FL and FR are forcedly set to "LARGE" and the setup set by the user in which the front speakers FL and FR are "SMALL" is buffered (step S111). When the operation to change the set values is executed by the jog operation of the rotary encoder 82C or the like in the menu on which the front speakers FL and FR are set by the user, the setup of the front speakers FL and FR stored in the buffer is cleared and the dark-out display is cancelled as a result irrespective of whether the set values have been changed or not (step S112). Even if the setup of the sub woofer SW is returned to "is used (YES)" in this state, the setup of the front speakers FL and FR is held to be "LARGE".

Also in such a normal setup, the speaker setup can be made by using an easier display. For simplicity of explanation here, it is assumed that the setting operation unit has the foregoing construction of FIG. 16B comprising: the two rotary encoders 82B and 82C; and the two keys 81A and 81B.

Figure 39A:
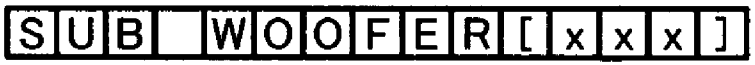
FIGS. 39A to 39E are diagrams for explaining the setting operation of an example using the display which can display 15 characters.
Figure 39B:
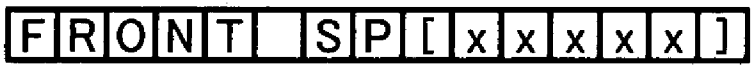
Figure 39C:
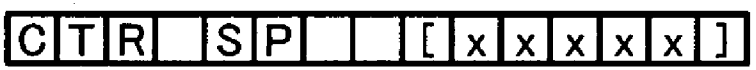
Figure 39D:
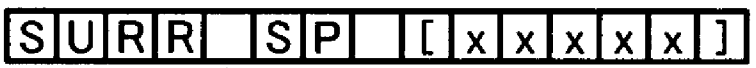
Figure 39E:
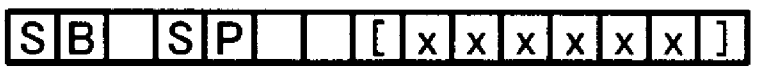

FIGS. 39A to 39E show the example in the case of making the normal setup by using the display 85 which can display 15 characters in FIG. 17B mentioned above. FIG. 39A shows the example of the display when the setup of the sub woofer SW is performed. FIG. 39B shows the example of the display when the setup of the front speakers FL and FR is performed. FIG. 39C shows the example of the display when the setup of the center speaker C is performed. FIG. 39D shows the example of the display when the setup of the surround speakers SL and SR is performed. FIG. 39E shows the example of the display when the setup of the surround back speakers SBL and SBR is performed. "xxx" in the diagrams indicates the set values. As mentioned above, the speaker name is properly abbreviated and displayed in accordance with the set contents, a length of speaker name, or the like.

FIGS. 40A to 40E show the example in the case of making the normal setup by using the display 85 which can display 8 characters in FIG. 17C mentioned above. FIG. 40A shows the example of the display when the setup of the sub woofer SW is performed. FIG. 40B shows the example of the display when the setup of the front speakers FL and FR is performed. FIG. 40C shows the example of the display when the setup of the center speaker C is performed. FIG. 40D shows the example of the display when the setup of the surround speakers SL and SR is performed. FIG. 40E shows the example of the display when the setup of the surround back speakers SBL and SBR is performed. In the example of FIGS. 40A to 40E, since the number of characters which can be displayed is small, only the set contents are displayed with respect to each speaker. It is preferable to separately display the speaker name so that the user can clearly grasp the speaker whose setup is being made at present. In this example, the abbreviation (FL, FR, C, SL, SR, SB, SW) of each speaker and the characters of the relevant abbreviation are lit on and frames of the characters flicker.

Also in the examples of FIGS. 39A to 40E, for example, the speakers to be set are sequentially switched by operating the rotary encoder 82B, and the set values are selected by operating the rotary encoder 82C. The selected set values are determined on the spot.

Figure 41A:
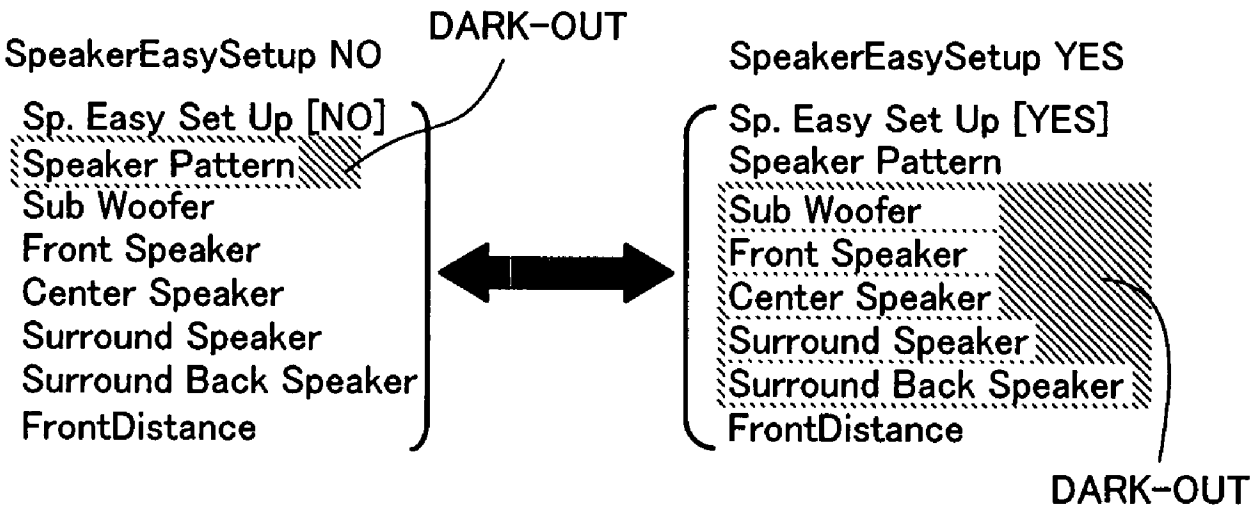
FIGS. 41A and 41B are schematic diagrams showing examples of items which are sequentially displayed in the easy setup and the normal setup.
Figure 41B:
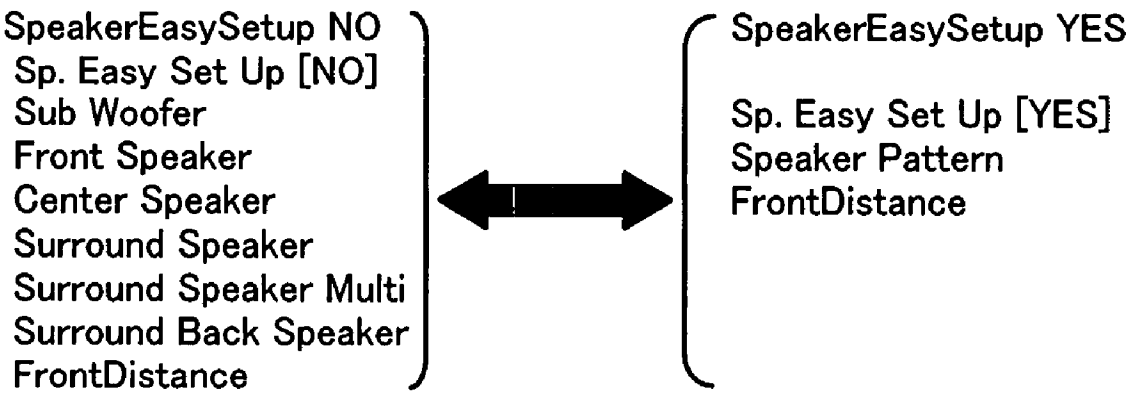

Since the set items in the easy setup and those in the normal setup are different, in each setup mode, if the set items which are not used are dark-out displayed or the display of the set items which are not used is skipped, the user can easily discriminate the items to be set. Therefore, such a method is preferable. FIGS. 41A and 41B show an example of the items which are sequentially displayed by operating the rotary encoder 82B when the speaker setup is selected on a customization menu in the easy setup and the normal setup.

In the example of FIG. 41A, when the easy setup is selected, the items of the speaker setting pattern are normally displayed and the set items of the sub woofer SW, the front speakers FL and FR, the center speaker C, the surround speakers SL and SR, and the surround back speakers SBL and SBR are dark-out displayed. If the normal setup is selected (the easy setup is "NO"), the items of the speaker setting pattern are dark-out displayed and the set items of each speaker are normally displayed.

In the example of FIG. 41B, when the easy setup is selected, although the items of the speaker setting pattern are displayed, the set items of each speaker are skipped and not displayed. When the normal setup is selected (the easy setup is "NO"), the items of the speaker setting pattern are skipped and the set items of each speaker are sequentially displayed.

In FIGS. 41A and 41B, since the item about whether the easy setup is selected or not and the item of "Front Distance" are common in both of the easy setup and the normal setup, they are normally displayed.

Since the common speaker setup is handled in the easy setup and the normal setup, there is always a correspondence relation between the easy setup and the normal setup. That is, if the normal setup is selected after completion of the setup in the easy setup, the set values of each speaker set in the easy setup are reflected to the set values of each speaker in the normal setup. Similarly, if the easy setup is selected after completion of the setup in the normal setup, the set values of each speaker set in the normal setup are reflected to the set values of each speaker in the easy setup. In this case, the set result by the normal setup is reflected to the pattern number in the easy setup.

As mentioned above, by sharing the set result by the easy setup and the set result by the normal setup, the setting method can be selected in accordance with the knowledge of the user regarding the speaker setup. Also in the case where the user wants to make the setup with respect to each speaker, if they are set in detail in the normal setup after they were schematically set in the easy setup, the number of operations decreases and the speaker setup can be easily performed as compared with the case of individually setting all items in the normal setup.

Although the explanation has been made above with respect to the case where all setups are made by using the keys 81A and 81B (81C and 81D) of the setting input unit and the rotary encoders 82A, 82B, and 82C provided on the front panel of the AV acoustic apparatus 1, the invention is not limited to such an example. For example, it is also possible to construct the apparatus in such a manner that operating means which can operate the speaker setup is provided for the remote control commander corresponding to the AV acoustic apparatus 1 and the speaker setup is made by using the remote control commander. In remote control commander, the control signal according to the operation is modulated into an infrared signal and transmitted. The infrared signal is received by the receiving unit 83 of the operation input unit 80, demodulated to the original control signal, supplied to the microcomputer 60, and the speaker setup is performed.

Although the case where the inputs of the pattern numbers are sequentially switched and selected by using the rotary encoder 82C or the like and inputted has been described above, the invention is not limited to such an example. For example, the pattern number can be directly inputted by using numeral keys or the like.

As described above, according to the invention, in the AV acoustic apparatus which can reproduce the surround sounds, the speaker setups which can be set are previously stored into the memory in association with the pattern numbers. Therefore, there is such an effect that the user can perform the setups to a plurality of speakers in a lump simply by inputting the pattern number by a predetermined method.

The more the number of channels of the speakers increases (5.1ch<6.1ch<7.1ch<9.1ch or more), the more the number of set items increases. Therefore, the larger the number of channels is, the larger effect is obtained. Even if the number of channels increases, the number of speaker setting patterns merely increases and the number of items to be set is always equal to 1. Therefore, there is such an effect that even if the number of speakers increases or decreases after completion of the speaker setup, the setup can be easily made.

A large effect is obtained when the embodiment of the invention is applied to low-price articles of low costs, a basic model, or an article group for beginners who desire the easy operation. Naturally, even if the invention is applied to a high-end model or articles for the high-ranking persons, a high effect such as an easy operation is obtained.

According to the invention, since the speaker setup can be expressed by the pattern number or one symbol, a useful effect is obtained even in terms of a quality management, maintenance, or the like. Further, since the information can be developed only from the pattern number or the symbol, there is such an effect that the capacity of the data storing medium for storing the speaker setups can be reduced.

Moreover, by applying the invention, even when the speaker setup is made to the AV acoustic apparatus of the main body from an external apparatus such as a remote control commander or the like, it is sufficient to transmit only the pattern number to the main body from the remote control commander. Since there is no need to transmit a number of set items to the main body, there is such an effect that the data transmitting time can be reduced and the number of codes for data transmission and reception can be decreased. Particularly, since it is sufficient to input only the pattern number in the operation of the remote control commander and there is no need to input the data while tracing a layer of each speaker setup, there is such an effect that it is sufficient to provide only one dedicated key for making the speaker setup for the remote control commander. There is consequently such an effect that the user can easily perform the speaker setup while listening to the surround sounds.

The present invention is not limited to the foregoing embodiment but many modifications and variations are possible within the spirit and scope of the appended claims of the invention.

What is claimed is:

1. An acoustic apparatus to which three or more speakers can be connected and that can reproduce surround sounds, comprising:

output control means for controlling audio signal outputs of a plurality of channels;

a table for storing information representing a plurality of different speaker setups that can be constructed by said plurality of channels and storing a plurality of identification codes for identifying said plurality of different speaker setups in correspondence to each other, each respective speaker setup having a respective number of speakers in which each speaker is a respective type of speaker, wherein each respective speaker setup is different from each other;

operating means having an easy setup mode for selecting an identification code corresponding to a desired speaker setup from said plurality of identification codes in accordance with an operation by a user, said operating means further having an individual setup mode in which control for every speaker in said desired speaker setup is individually set by said user;

selection means for selecting between said easy setup mode and said individual setup mode in accordance with an operation by said user; and display means for displaying said identification code selected by said user in said easy setup mode, wherein said acoustic apparatus has a batch setup mode in which said control for every speaker in said desired speaker setup is set based on said identification code selected by said user in said easy setup mode, and wherein said easy setup mode is used for an initial speaker arrangement prior to normal operation of the acoustic apparatus.

2. The acoustic apparatus according to claim 1, wherein predetermined limitations are provided for each of the different speaker setups that can be constructed by said plurality of channels.

3. The acoustic apparatus according to claim 1, wherein said display means displays a speaker setup and a corresponding identification code.

4. The acoustic apparatus according to claim 1, wherein said display means displays a three-dimensional display.

5. The acoustic apparatus according to claim 1, wherein said display means output the display to an external monitor apparatus.

6. The acoustic apparatus according to claim 1, wherein said control of every speaker set by the batch setup mode can be changed in said individual setup mode.

7. A method for setting up an acoustic apparatus to which three or more speakers can be connected and that can reproduce surround sounds, comprising:

controlling audio signal outputs of a plurality of channels;

storing in a table information representing a plurality of different speaker setups that can be constructed by said plurality of channels and storing in the table a plurality of identification codes for identifying said plurality of different speaker setups in correspondence to each other, each respective speaker setup having a respective number of speakers in which each speaker is a respective type of speaker, wherein each respective speaker setup is different from each other;

providing an easy setup mode for selecting an identification code corresponding to a desired speaker setup from said plurality of identification codes in accordance with an operation by a user, and providing an individual setup mode in which control for every speaker in said desired speaker setup is individually set by said user;

selecting between said easy setup mode and said individual setup mode in accordance with an operation by said user; and displaying said identification code selected by said user in said easy setup mode, wherein said acoustic apparatus has a batch setup mode in which said control for every speaker in said desired speaker setup is set based on said identification code selected by said user in said easy setup mode, and wherein said easy setup mode is used for an initial speaker arrangement prior to normal operation of the acoustic apparatus.

* * * * *